US011350703B2

(12) United States Patent
Sullivan

(10) Patent No.: US 11,350,703 B2
(45) Date of Patent: Jun. 7, 2022

(54) ARTICLES OF FOOTWEAR WITH WRAP AROUND CLOSURE SYSTEM AND/OR FOOT WRAPPING SECURING STRAPS

(71) Applicant: NIKE, Inc., Beaverton, OR (US)

(72) Inventor: Gerald Sullivan, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 16/184,517

(22) Filed: Nov. 8, 2018

(65) Prior Publication Data

US 2019/0133255 A1 May 9, 2019

Related U.S. Application Data

(60) Provisional application No. 62/582,988, filed on Nov. 8, 2017.

(51) Int. Cl.
*A43C 11/00* (2006.01)
*A43C 11/12* (2006.01)
(Continued)

(52) U.S. Cl.
CPC ..... *A43C 11/008* (2013.01); *A43B 3/02* (2013.01); *A43B 5/00* (2013.01); *A43B 11/00* (2013.01);
(Continued)

(58) Field of Classification Search
CPC ..... A43C 11/008; A43C 11/002; A43C 11/12; A43C 11/14; A43C 11/16; A43C 11/22;
(Continued)

(56) References Cited

U.S. PATENT DOCUMENTS 2,200,080 A 5/1940 Fein
2,302,596 A 11/1942 Bigio
(Continued)

FOREIGN PATENT DOCUMENTS

CN 101312670 A 11/2008
CN 201675105 U 12/2010
(Continued)

OTHER PUBLICATIONS

Feb. 12, 2019—(WO)—ISR & WO—App. No. PCT/US18/059788.
Oct. 28, 2021—(EP) ESR—App. No. 21196885.4.

*Primary Examiner* — Khoa D Huynh
*Assistant Examiner* — Uyen T Nguyen
(74) *Attorney, Agent, or Firm* — Banner & Witcoff, Ltd.

(57) ABSTRACT

Articles of footwear may include an upper formed from one or more upper parts, wherein at least one upper part defines an ankle-containing portion of the upper and at least one upper part (the same upper part or a different upper part) defines an instep-containing portion of the upper. The foot-insertion opening of the upper (which may include a closure system) may extend: (i) from a first side of an ankle-containing portion of the upper, (ii) around a rear heel or ankle area of the upper, (iii) along a second side of the ankle-containing portion of the upper, and (iv) to an instep-containing portion of the upper. One or more additional straps (e.g., an ankle strap, one or more interior bootie straps, etc.), fasteners, and/or locks may be provided to engage the upper/footwear with the wearer's foot.

17 Claims, 13 Drawing Sheets

(51) Int. Cl.

| | |
|---|---|
| ***A43B 11/00*** | (2006.01) |
| ***A43B 23/02*** | (2006.01) |
| ***A43C 11/06*** | (2006.01) |
| ***A43B 3/02*** | (2006.01) |
| ***A43B 5/00*** | (2022.01) |
| ***A43B 19/00*** | (2006.01) |

(52) U.S. Cl.
CPC ..... *A43B 19/00* (2013.01); *A43B 23/02* (2013.01); *A43C 11/002* (2013.01); *A43C 11/004* (2013.01); *A43C 11/06* (2013.01); *A43C 11/12* (2013.01)

(58) Field of Classification Search
CPC .... A43C 7/08; A43C 7/00; A43C 1/00; A43C 1/003; A43C 1/006; A43C 1/06; A43C 11/165; A43B 23/02; A43B 23/0235; A43B 23/0245; A43B 5/00; A43B 11/00
USPC ..... 36/83
See application file for complete search history.

(56) References Cited

U.S. PATENT DOCUMENTS

| | | | | |
|---|---|---|---|---|
| 2,326,776 | A | 8/1943 | Gellman | |
| 2,330,224 | A | 9/1943 | L'Hollier | |
| 2,494,770 | A | 1/1950 | MacLaughlin | |
| 2,742,717 | A | 4/1956 | Murray | |
| 4,079,527 | A | 3/1978 | Antonious | |
| 4,451,995 | A | 6/1984 | Antonious | |
| 4,486,965 | A | 12/1984 | Friton | |
| 4,628,622 | A | 12/1986 | McBarron | |
| 4,665,634 | A | 5/1987 | Diaz | |
| 4,706,392 | A | 11/1987 | Yang | |
| 4,745,693 | A | 5/1988 | Brown | |
| 4,811,498 | A * | 3/1989 | Barret | A43B 7/1495 36/117.2 |
| 5,353,483 | A | 10/1994 | Louviere | |
| 6,578,288 | B2 | 6/2003 | Bernstein | |
| 6,874,256 | B2 | 4/2005 | Delgatty | |
| 6,941,683 | B2 | 9/2005 | Freed | |
| 7,607,242 | B2 | 10/2009 | Karandonis et al. | |
| 7,614,165 | B2 | 11/2009 | Curry | |
| D635,746 | S | 4/2011 | Cofinco | |
| 8,161,669 | B2 | 4/2012 | Keating | |
| D741,054 | S | 10/2015 | Stillwagon | |
| 9,295,305 | B2 | 3/2016 | Patel et al. | |
| 9,516,920 | B1 * | 12/2016 | DeRose | A43B 3/26 |
| 9,526,300 | B2 * | 12/2016 | Krengel | A43C 7/00 |
| 9,797,421 | B2 * | 10/2017 | Gaudillere | F16G 11/108 |
| 9,839,261 | B2 | 12/2017 | Hatfield et al. | |
| 10,178,893 | B1 * | 1/2019 | Baker | A43B 3/02 |
| 10,874,166 | B2 * | 12/2020 | Fortener | A43B 7/144 |
| 2002/0178616 | A1 | 12/2002 | Williams | |
| 2004/0003516 | A1 | 1/2004 | Jacobs | |
| 2005/0115111 | A1 * | 6/2005 | Yamashita | A43B 5/00 36/89 |
| 2007/0180730 | A1 * | 8/2007 | Greene | A43B 23/0295 36/3 A |
| 2008/0034555 | A1 * | 2/2008 | Cheng | F16G 11/101 24/115 G |
| 2008/0168683 | A1 | 7/2008 | Keating | |
| 2008/0229613 | A1 | 9/2008 | Park | |
| 2009/0100717 | A1 * | 4/2009 | Cabanis | A43B 5/0411 36/116 |
| 2009/0217552 | A1 | 9/2009 | Paintin et al. | |
| 2011/0113650 | A1 * | 5/2011 | Hurd | A43B 7/20 36/107 |
| 2011/0296711 | A1 | 12/2011 | Nelson et al. | |
| 2012/0011744 | A1 | 1/2012 | Bell et al. | |
| 2012/0079746 | A1 | 4/2012 | Ferreira et al. | |
| 2012/0117821 | A1 | 5/2012 | Adams | |
| 2012/0198720 | A1 | 8/2012 | Farris et al. | |
| 2013/0086815 | A1 * | 4/2013 | Toraya | A43C 7/005 36/83 |
| 2014/0047736 | A1 | 2/2014 | Lehmkuhler | |
| 2014/0157624 | A1 * | 6/2014 | Girard | A43B 23/0245 36/50.1 |
| 2014/0196313 | A1 * | 7/2014 | Hatfield | A43C 11/12 36/83 |
| 2015/0096201 | A1 * | 4/2015 | Marcon | A43B 23/06 36/109 |
| 2015/0216252 | A1 | 8/2015 | Wiens | |
| 2015/0257476 | A1 * | 9/2015 | Panian | A43B 23/07 36/114 |
| 2015/0289580 | A1 * | 10/2015 | Holt | A43B 7/12 36/102 |
| 2016/0058127 | A1 * | 3/2016 | Burns | F41C 33/0209 36/58.5 |
| 2016/0128429 | A1 | 5/2016 | Hatfield et al. | |
| 2016/0270484 | A1 | 9/2016 | Zadnik | |
| 2016/0309844 | A1 * | 10/2016 | Smith | A43C 11/1493 |
| 2017/0042290 | A1 | 2/2017 | Hatfield et al. | |
| 2017/0055642 | A1 * | 3/2017 | Krengel | A43C 3/00 |
| 2017/0224056 | A1 * | 8/2017 | Midorikawa | A43C 11/20 |
| 2018/0213890 | A1 | 8/2018 | Innocente | |

FOREIGN PATENT DOCUMENTS

| | | | |
|---|---|---|---|
| CN | 201995678 | U | 10/2011 |
| CN | 104544704 | A | 4/2015 |
| CN | 105188452 | A | 12/2015 |
| DE | 534443 | C | 9/1931 |
| DE | 8203280 | U1 | 11/1982 |
| DE | 3204260 | A1 | 11/1983 |
| DE | 3442147 | A1 | 5/1986 |
| EP | 0094474 | A1 | 11/1983 |
| EP | 1430802 | A1 | 6/2004 |
| FR | 2617379 | A1 | 1/1989 |
| JP | S61141302 | A | 6/1986 |
| JP | H06315403 | A | 11/1994 |
| JP | H10057112 | A | 3/1998 |
| JP | 2009297151 | A | 12/2009 |
| JP | 2015073906 | A | 4/2015 |
| WO | 2005029991 | A1 | 4/2005 |
| WO | 2017066415 | A1 | 4/2017 |

* cited by examiner

ARTICLES OF FOOTWEAR WITH WRAP AROUND CLOSURE SYSTEM AND/OR FOOT WRAPPING SECURING STRAPS

RELATED APPLICATION DATA

This application claims priority benefits to and is a U.S. Non-Provisional patent application based on U.S. Provisional Patent Appln. No. 62/582,988 filed Nov. 8, 2017. U.S. Provisional Patent Appln. No. 62/582,988 is entirely incorporated herein by reference.

FIELD OF THE INVENTION

The present invention relates to the field of footwear. More specifically, aspects of the present invention pertain to articles of footwear having closure systems that at least partially wrap around the wearer's foot and/or include securing straps that at least partially wrap around the wearer's foot.

Terminology/General Information

First, some general terminology and information is provided that will assist in understanding various portions of this specification and the invention(s) as described herein. As noted above, the present invention relates to the field of footwear. "Footwear" means any type of wearing apparel for the feet, and this term includes, but is not limited to: all types of shoes, boots, sneakers, sandals, thongs, flip-flops, mules, scuffs, slippers, sport-specific shoes (such as track shoes, golf shoes, tennis shoes, baseball cleats, soccer or football cleats, ski boots, basketball shoes, cross training shoes, etc.), and the like.

FIG. 1 also provides information that may be useful for explaining and understanding the specification and/or aspects of this invention. More specifically, FIG. 1 provides a representation of a footwear component 100, which in this illustrated example constitutes a portion of a sole structure for an article of footwear. The same general definitions and terminology described below may apply to footwear in general and/or to other footwear components or portions thereof, such as an upper, a midsole component, an outsole component, a ground-engaging component, etc.

First, as illustrated in FIG. 1, the terms "forward" or "forward direction" as used herein, unless otherwise noted or clear from the context, mean toward or in a direction toward a forward-most toe ("FT") area of the footwear structure or component 100. The terms "rearward" or "rearward direction" as used herein, unless otherwise noted or clear from the context, mean toward or in a direction toward a rear-most heel area ("RH") of the footwear structure or component 100. The terms "lateral" or "lateral side" as used herein, unless otherwise noted or clear from the context, mean the outside or "little toe" side of the footwear structure or component 100. The terms "medial" or "medial side" as used herein, unless otherwise noted or clear from the context, mean the inside or "big toe" side of the footwear structure or component 100.

Also, various example features and aspects of this invention may be disclosed or explained herein with reference to a "longitudinal direction" and/or with respect to a "longitudinal length" of a footwear component 100 (such as a footwear sole structure, a footwear upper, or an overall article of footwear). As shown in FIG. 1, the "longitudinal direction" is determined as the direction of a line extending from a rear-most heel location (RH in FIG. 1) to the forward-most toe location (FT in FIG. 1) of the footwear component 100 in question (a sole structure or foot-supporting member in this illustrated example). The "longitudinal length" L is the length dimension measured from the rear-most heel location RH to the forward-most toe location FT. The rear-most heel location RH and the forward-most toe location FT may be located by determining the rear heel and forward toe tangent points with respect to front and back parallel vertical planes VP when the component 100 (e.g., sole structure or foot-supporting member in this illustrated example, e.g., as part of an article of footwear or foot-receiving device) is oriented on a horizontal support surface S in an unloaded condition (e.g., with no weight or force applied to it other than potentially the weight/force of the shoe components with which it is engaged). If the forward-most and/or rear-most locations of a specific footwear component 100 constitute a line segment (rather than a tangent point), then the forward-most toe location and/or the rear-most heel location constitute the mid-point of the corresponding line segment. If the forward-most and/or rear-most locations of a specific footwear component 100 constitute two or more separated points or line segments, then the forward-most toe location and/or the rear-most heel location constitute the mid-point of a line segment connecting the furthest spaced and separated points and/or furthest spaced and separated end points of the line segments (irrespective of whether the midpoint itself lies on the component 100 structure). If the forward-most and/or rear-most locations constitute one or more areas, then the forward-most toe location and/or the rear-most heel location constitute the geographic center of the area or combined areas (irrespective of whether the geographic center itself lies on the component 100 structure).

Once the longitudinal direction of a component or structure 100 has been determined with the component 100 oriented on a horizontal support surface S in an unloaded condition, planes may be oriented perpendicular to this longitudinal direction (e.g., planes running into and out of the page of FIG. 1). The locations of these perpendicular planes may be specified based on their positions along the longitudinal length L where the perpendicular plane intersects the longitudinal direction between the rear-most heel location RH and the forward-most toe location FT. In this illustrated example of FIG. 1, the rear-most heel location RH is considered as the origin for measurements (or the "0L position") and the forward-most toe location FT is considered the end of the longitudinal length of this component (or the "1.0L position"). Plane position may be specified based on its location along the longitudinal length L (between 0L and 1.0L), measured forward from the rear-most heel RH location in this example. FIG. 1 shows locations of various planes perpendicular to the longitudinal direction (and oriented in the transverse direction) and located along the longitudinal length L at positions 0.25L, 0.4L, 0.5L, 0.55L, 0.6L, and 0.8L (measured in a forward direction from the rear-most heel location RH). These planes may extend into and out of the page of the paper from the view shown in FIG. 1, and similar planes may be oriented at any other position along the longitudinal length L. While these planes may be parallel to the parallel vertical planes VP used to determine the rear-most heel RH and forward-most toe FT locations, this is not a requirement. Rather, the orientations of the perpendicular planes along the longitudinal length L will depend on the orientation of the longitudinal direction, which may in some instances, and may not in other instances, be parallel to the horizontal surface S and/or perpendicular to the vertical planes VP in the arrangement/orientation shown in FIG. 1.

BRIEF DESCRIPTION OF THE DRAWINGS

The following Detailed Description will be better understood when read in conjunction with the accompanying drawings in which like reference numerals refer to the same or similar elements in all of the various views in which that reference number appears.

Figure 1:
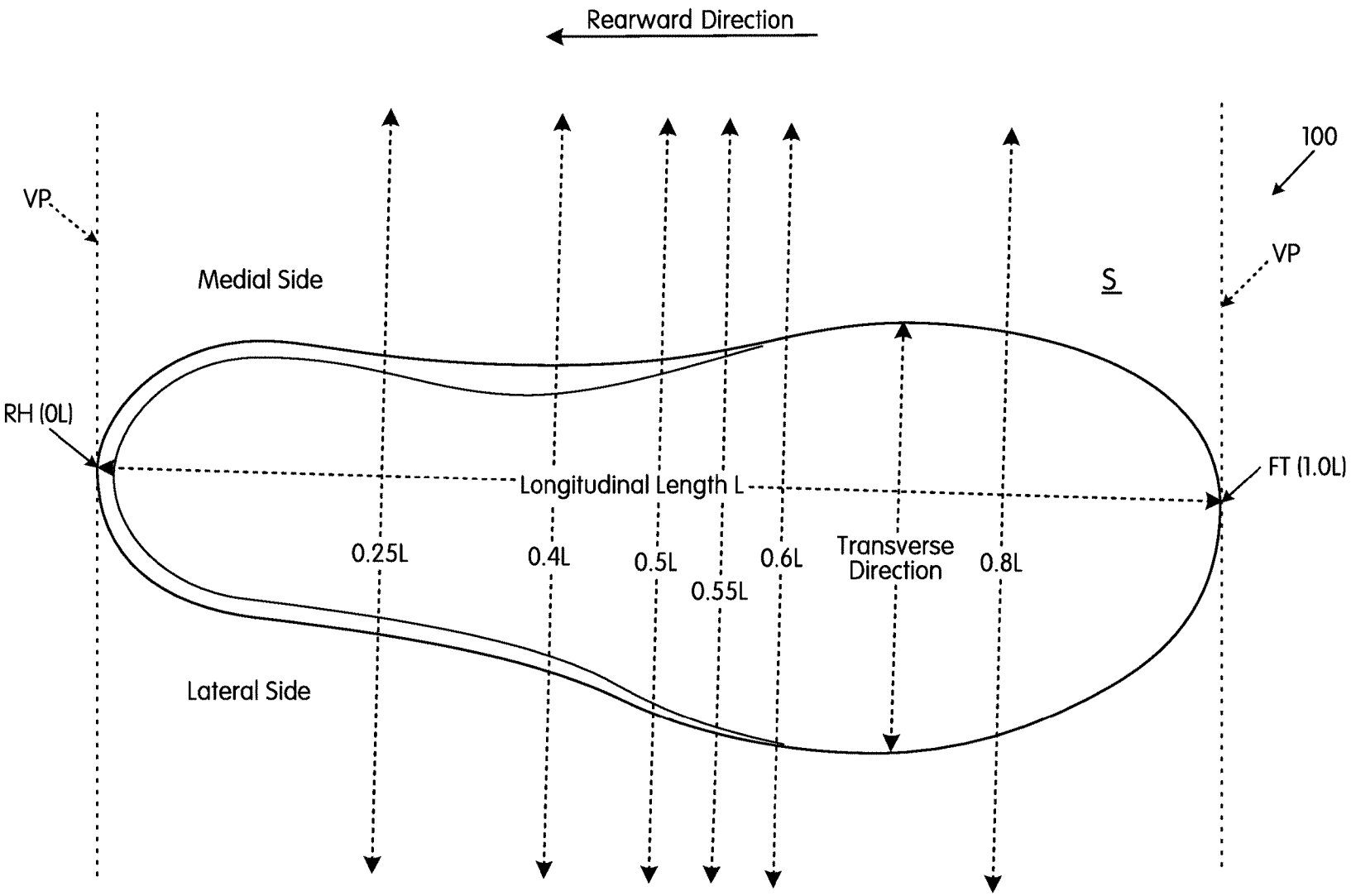
FIG. 1 is provided to help illustrate and explain background and definitional information useful for understanding certain terminology and aspects of this invention.

The reader should understand that the attached drawings are not necessarily drawn to scale.

DETAILED DESCRIPTION

In the following description of various examples of footwear structures and components according to aspects of the present invention, reference is made to the accompanying drawings, which form a part hereof, and in which are shown by way of illustration various example structures and environments in which aspects of the invention may be practiced. It is to be understood that other structures and environments may be utilized and that structural and functional modifications may be made from the specifically described structures and functions without departing from the scope of the present invention.

I. GENERAL DESCRIPTION OF SOME EXAMPLE ASPECTS OF THE INVENTION

While potentially useful for any type or style of shoes, aspects of this invention may be of particular interest for boots; athletic shoes, including basketball shoes; or other footwear, including footwear with hightop uppers.

Articles of footwear in accordance with at least some examples of this invention may include an upper formed from one or more upper parts, wherein at least one upper part defines an ankle-containing portion of the upper and at least one upper part (the same upper part or a different upper part) defines an instep-containing portion of the upper. A foot-insertion opening of the upper—which may include a closure system—may extend either of partially or continuously: (i) from a first side of an ankle-containing portion of the upper, (ii) around a rear heel or ankle area of the upper, (iii) along a second side of the ankle-containing portion of the upper, and (iv) to an instep-containing portion of the upper. In some embodiments, the foot-insertion opening may extend across an instep-containing portion of the upper and to a first side of the instep-containing portion of the upper (e.g., across a central longitudinal axis of the upper at a forefoot portion of the upper). In other embodiments, the foot-insertion opening may extend to a location in a forefoot portion of the upper at or short of a central longitudinal axis of the upper at the forefoot portion of the upper (e.g., not across the central longitudinal axis of the upper at the forefoot portion of the upper). One or more additional straps (e.g., an ankle strap, one or more interior bootie straps, etc.), fasteners, and/or locks may be provided to engage the upper/footwear with the wearer's foot.

Some aspects of this invention relate to articles of footwear that include: (a) an upper formed from one or more upper parts, which may be engaged with a sole structure for the article of footwear, wherein at least one upper part defines an ankle-containing portion of the upper and at least one upper part (the same upper part or a different upper part) defines an instep-containing portion of the upper; and (b) a closure system engaged with the upper. The closure system in accordance with at least some examples of this aspect of the invention may include: (i) a track that extends from a first end (e.g., an open end) located at a first side of the ankle-containing portion of the upper to a second end (e.g., a closed end) located at the instep-containing portion of the upper (e.g., located at a first side of the instep-containing portion of the upper, located at a second side of the instep-containing portion, located at a lateral side of the article of footwear, located at a medial side of the article of footwear, located at or to either side of a central longitudinal axis of the upper at a forefoot portion of the upper, etc.), wherein the track extends around a rear ankle area of the ankle-containing portion, along a second side of the ankle-containing portion, and to the instep-containing portion of the upper (e.g., in some embodiments across a central portion of the instep-containing portion located between the first side of the instep-containing portion and a second side of the instep-containing portion, in some embodiments across a central longitudinal axis of the upper at a forefoot portion of the upper, or in some embodiments to a location at or short of a central longitudinal axis of the upper at a forefoot portion of the upper) and (ii) a slider engaged with the track. The slider is movable along the track to change the closure system between an open condition (a foot-insertion or foot-removal condition) and a closed condition (a foot-securing condition). The track may extend across a central longitudinal axis of the upper at a location forward of a foot-insertion opening of the upper, or it may terminate at a forefoot portion of the upper at or short of the central longitudinal axis of the upper at the forefoot portion of the upper. The track and slider may constitute a zipper structure, an interlocking pressure track structure, or other closure systems that are opened and closed using a movable slider along a track.

In at least some examples of this aspect of the invention, an ankle strap may be engaged with the slider, and this ankle strap may include and/or may releasably engage a fastener. At least a portion of the fastener may be provided on or as part of the upper, e.g., located at the second side of the ankle-containing portion of the upper. When the closure system is in the closed condition, the fastener may engage the ankle strap with the upper to secure the upper around the wearer's ankle/foot. At least a portion of the fastener may be located between the track and a top of a foot-insertion opening of the upper, it may bridge the track, and/or it may be located below the track. The fastener may include any type of releasable securing component, such as one or more of: one or more snaps, one or more buttons, one or more hook-and-loop fasteners, one or more buckles, one or more laces or ties, one or more magnets, or the like.

The ankle strap, when present, may extend from the first side of the ankle-containing portion (e.g., at the end of the slider track, e.g., on a lateral side of the article of footwear), across the front of the wearer's foot/ankle (e.g., across the instep-containing portion of the upper), and to the second side of the ankle-containing portion (e.g., on a medial side of the article of footwear) when the closure system is in the closed condition and the fastener for the ankle strap is engaged. At least a portion of the fastener for the ankle strap may be located at the medial side of the footwear upper.

Figure 2A:
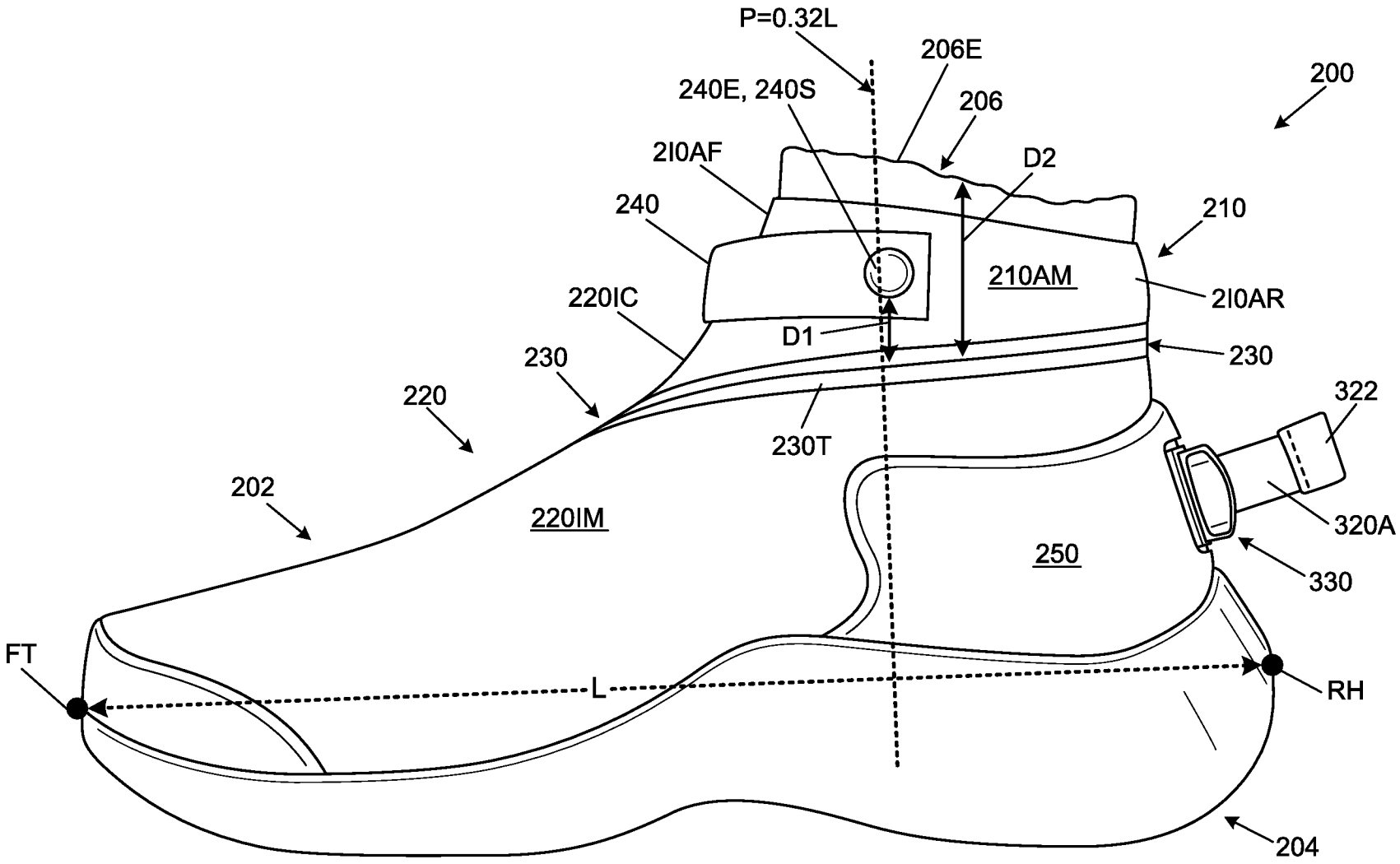
FIGS. 2A-2D provide various views of an article of footwear according to at least some examples of this invention including details of various exterior features of such articles of footwear.
Figure 2B:
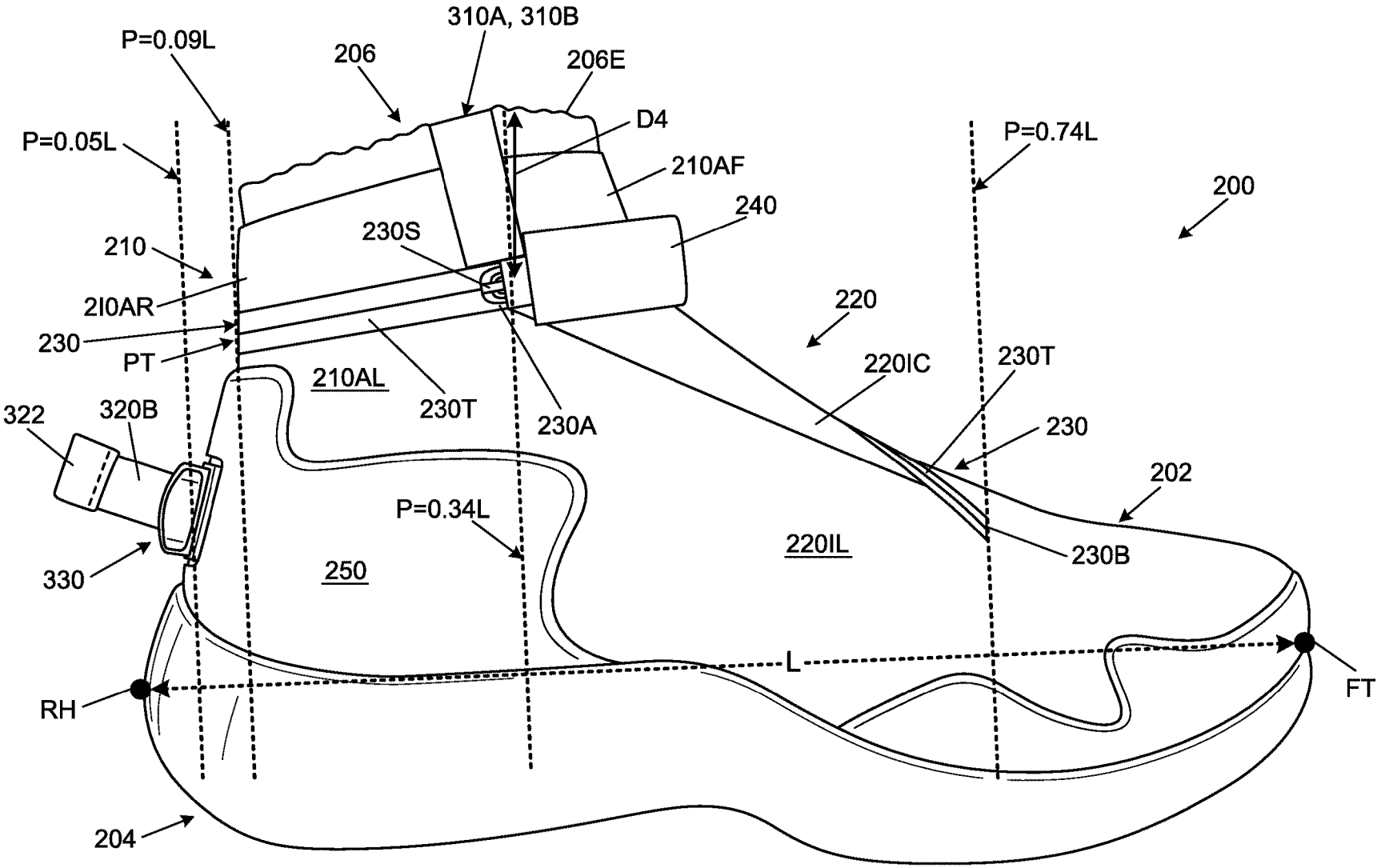
Figure 2D:
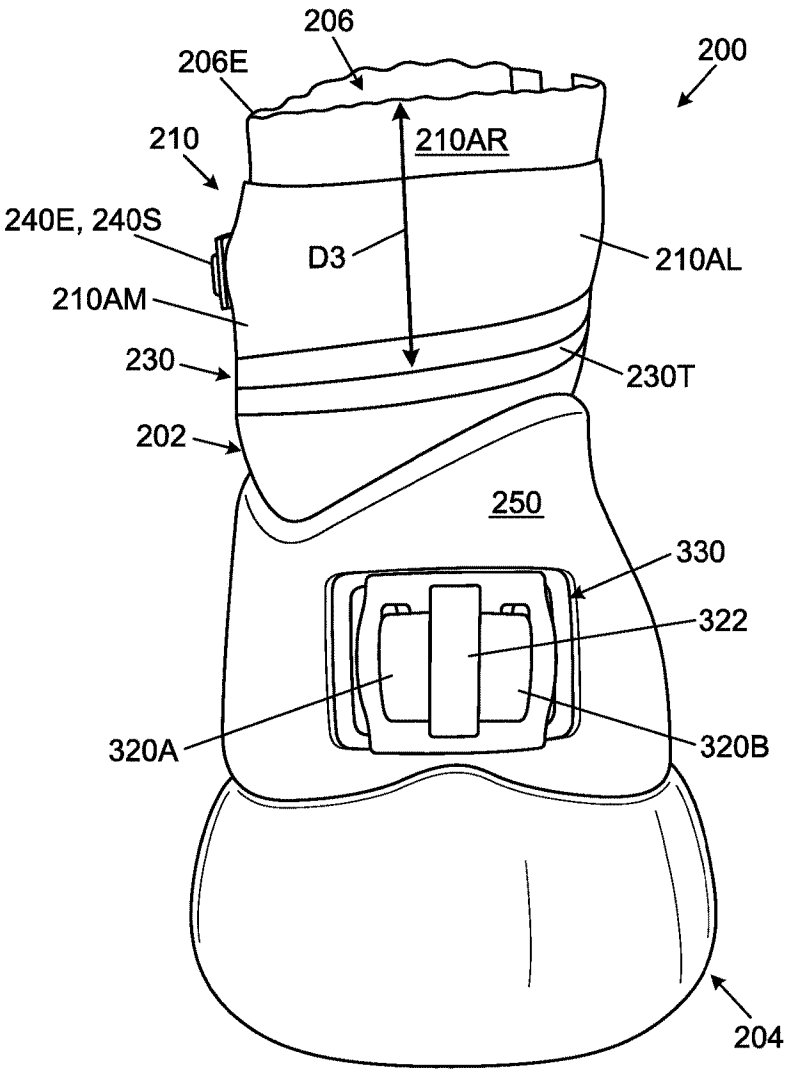
Figure 2C:
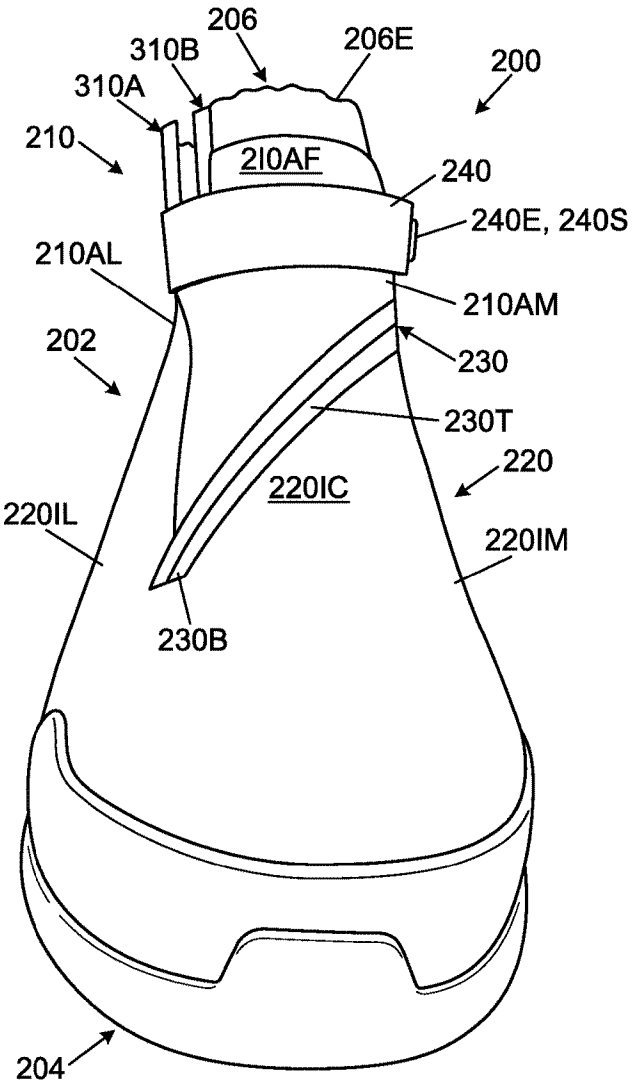
Figure 3A:
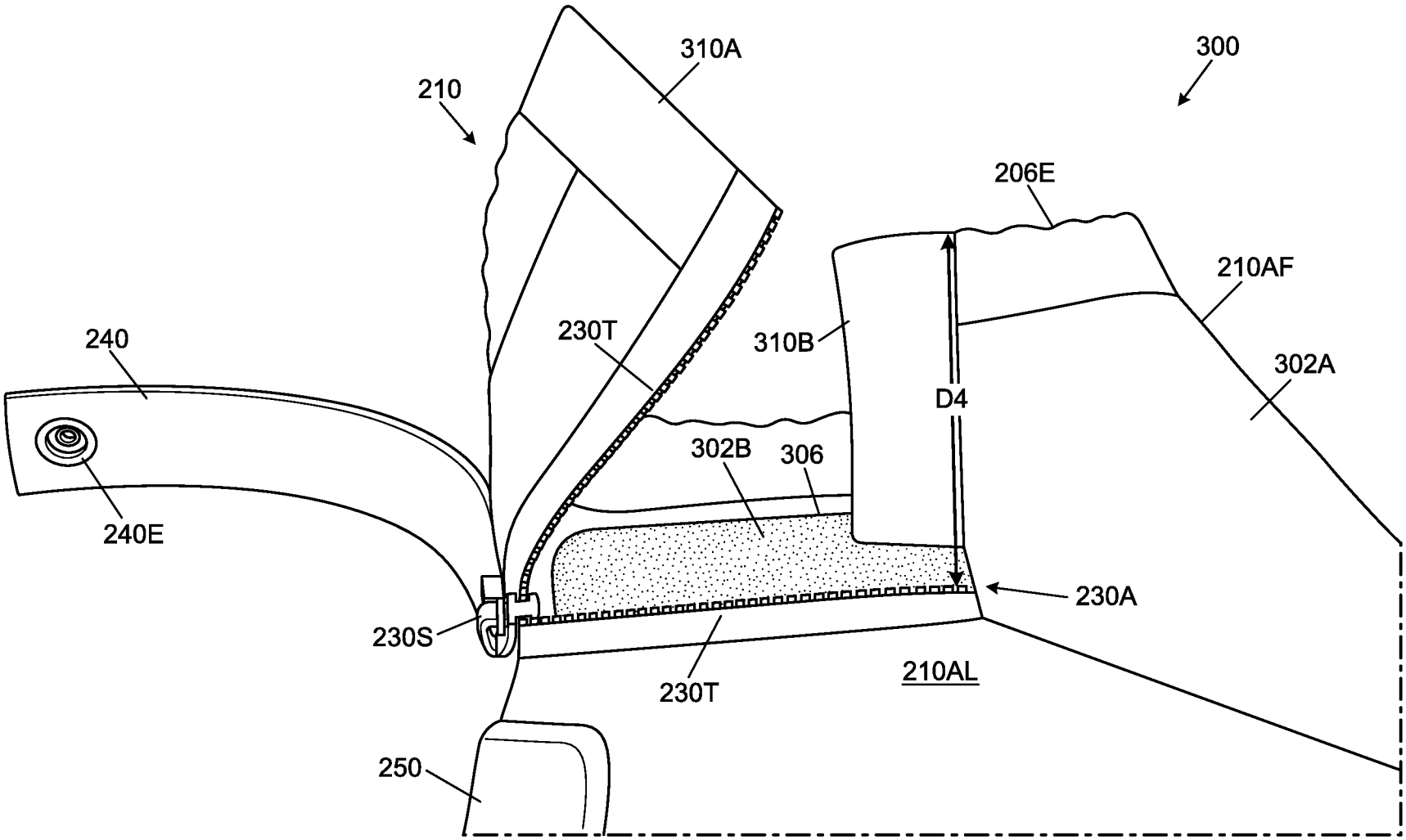
FIGS. 3A-3E provide various views of an article of footwear according to at least some examples of this invention including details of various interior and exterior features of such articles of footwear.
Figure 3B:
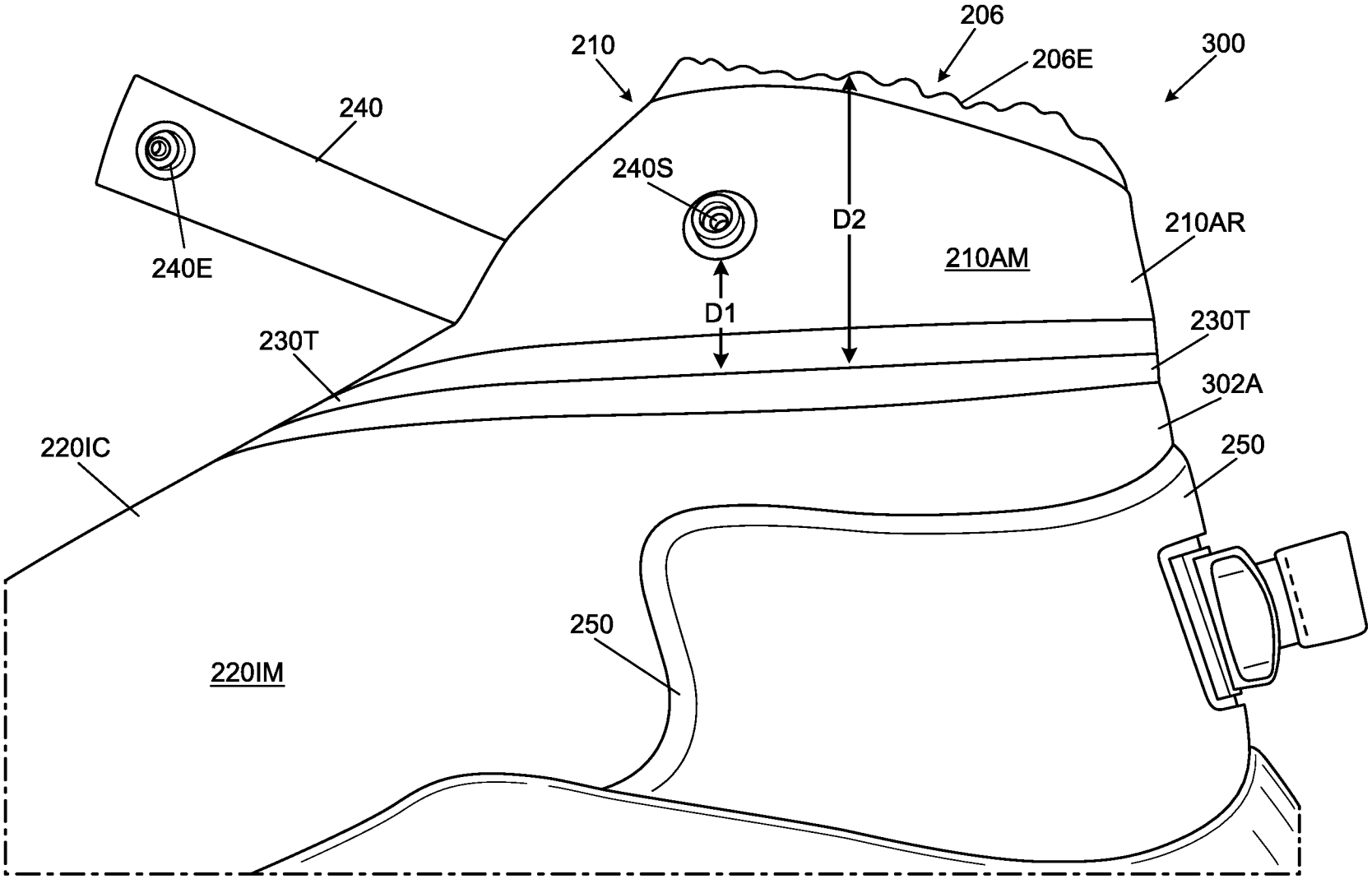

Various example dimensional features of uppers/articles of footwear in accordance with at least some examples of this invention now will be described. At least some examples of this invention may include any one or more of the following features:

(a) at least some portion of the track at the second side of the ankle-containing portion (e.g., the medial side) may be located a distance of less than 1.5 inch (3.81 cm), and in some examples, less than 1.25 inch (3.18 cm), less than 1 inch (2.54 cm), or even less than 0.75 inch (1.91 cm), from at least some portion of the fastener (e.g., a portion of the ankle strap fastener engaged with the upper)—note dimension D1 in FIGS. 2A and 3B;

(b) with the article of footwear orientated on a horizontal support surface in an unloaded condition, a rearmost ankle portion of the track may be located a distance of less than 2 inches (5.08 cm), and in some examples, less than 1.75 inch (4.45 cm), less than 1.5 inch (3.81 cm), or even less than 1.25 inch (3.18 cm), from at least some portion of a top edge of the upper (e.g., from a rearmost top point and/or rearmost top edge of the upper, from a top point or a top edge of the foot-insertion opening of the upper at the rearmost heel location RH of the upper, etc.)—note dimension D3 in FIG. 2D;

(c) the first end of the track (e.g., the open end of the slider track) may be located a distance of less than 2 inches (5.08 cm), and in some examples, less than 1.75 inch (4.45 cm), less than 1.5 inch (3.81 cm), or even less than 1.25 inch (3.18 cm) from at least some portion of a top of a foot-insertion opening of the upper (e.g., from a top point or top edge of the foot-insertion opening at the location directly vertically above the first end of the track when the footwear is oriented on a horizontal support surface in an unloaded condition)—note dimension D4 in FIGS. 2B and 3A; and/or (d) at least some portion of the track at the second side of the ankle-containing portion (e.g., at the medial side of the upper) may be located a distance of less than 2.25 inches (5.72 cm), less than 2 inches (5.08 cm), less than 1.75 inch (4.45 cm), less than 1.5 inch (3.81 cm), or even less than 1.25 inch (3.18 cm) from at least some portion of a top of a foot-insertion opening of the upper (e.g., from a top point or top edge of the foot-insertion opening at the location directly vertically above the track at the second side of the ankle-containing portion when the footwear is oriented on an horizontal support surface in an unloaded condition)—note dimension D2 in FIGS. 2A and 3B.

Uppers and/or articles of footwear according to at least some examples of this invention may include an exterior component and an interior component. In such structures, the closure system (e.g., the track) may be engaged with the exterior component, and/or the interior component may include a foot-receiving bootie (e.g., for completely or partially containing a wearer's foot within the footwear upper). This interior component further may include at least one strap engaged with the foot-receiving bootie, and the article of footwear (e.g., the upper, the sole structure, etc.) further may include a lock that releasably holds the at least one strap around a wearer's foot in a tightened condition. As a more specific example, the interior component may include: (a) a first strap section extending from a first side of a heel-containing area of the foot-receiving bootie to a second side of the foot-receiving bootie forward of a foot-receiving opening of the foot-receiving bootie, and (b) a second strap section extending from a second side of the heel-containing area of the foot-receiving bootie to a first side of the foot-receiving bootie forward of the foot-receiving opening of the foot-receiving bootie. The first strap section and the second strap section (which may be parts of one strap or two separate straps) may cross one another, e.g., at a location forward of the foot-receiving opening of the foot-receiving bootie. In at least some examples of this aspect of the invention: (a) the first strap section may extend along the first side of the heel-containing area of the foot-receiving bootie at a location inside the exterior component of the upper, (b) the second strap section may extend along the second side of the heel-containing area of the foot-receiving bootie at a location inside the exterior component of the upper, (c) the first strap section may extend outside of the exterior component of the upper at a first rear heel area of the upper, and/or (d) the second strap section may extend outside of the exterior component of the upper at the first rear heel area of the upper or at a second rear heel area of the upper.

The lock according to these examples/aspects of the invention may be any type of securing system for holding one or more straps in a tightened condition, and the lock may be located at any location on the article of footwear. As a more specific example, at least portion of the lock may be located at a rear heel area of the exterior component of the upper or a rear heel area of the sole structure. The first strap section and/or the second strap section may engage this lock, and the lock will releasably hold the first strap section and/or the second strap section in a tightened condition (e.g., around a wearer's foot). As some even more specific examples, the lock may include one or more spring loaded bearing surfaces that pinch the first strap section and/or the second strap section to hold it/them in place in the tightened condition; a ratcheted take-up reel for one or more of the strap sections; one or more clamps; one or more clips; one or more retainers; etc.

In other example articles of footwear according to at least some aspects of this invention, the article of footwear will include at least one strap engaged with the upper and a lock having at least one part engaged with at least one of the upper or the sole structure. The lock, which may have any of the structures and/or characteristics described above, will be structured and positioned to releasably secure the at least one strap in a tightened condition. The at least one strap further may include: (a) a first strap section extending between overlapping layers of the upper over at least a portion of its length (e.g., and extending from a first side of a heel-containing area of the upper to the second side of the instep-containing portion of the upper) and (b) a second strap section extending between overlapping layers of the upper over at least a portion of its length (e.g., and extending from a second side of the heel-containing area of the upper to the first side of the instep-containing portion of the upper). The first strap section may cross the second strap section forward of a foot-receiving opening of the upper. The lock may include one or more parts that engage one or more of the strap sections, and in some examples, will include structure(s) that engages (engage) both the first strap section and the second strap section. The lock may be located at any location(s) and/or engaged with any part(s) of the footwear structure (e.g., at a side of the upper and/or sole structure, at an instep area of the upper, at a rear heel area of the upper and/or sole structure, etc.).

Additional examples or aspects of this invention may include an article of footwear having: (a) an upper (e.g., having at least a first upper component and a second upper component in at least one embodiment); and/or (b) a first strap section extending along the upper (e.g., extending between the first upper component and the second upper component) and across an instep-containing portion of the upper; and/or (c) a second strap section extending along the upper (e.g., extending between the first upper component and the second upper component) and across the instep-containing portion of the upper; (d) a sole structure engaged with the upper; and/or (e) a lock engaged with at least one of the upper, the first strap section, the second strap section, or the sole structure (e.g., at a rear heel area of the article of footwear), wherein the lock releasably holds at least one of the first strap section or the second strap section in a tightened condition. The first strap section may extend from a medial side of the article of footwear (e.g., from a medial midfoot or medial forefoot area of the article of footwear), across the instep area of the article of footwear, around the lateral ankle area of the article of footwear, and to a rear heel location where it engages the lock. This first strap portion can be fixed to the upper (e.g., to the first upper component and/or the second upper component) and/or the sole structure (and/or another footwear component) at the medial midfoot and/or medial forefoot area (e.g., by stitching, adhesive, mechanical connector(s), etc.), e.g., at a location where the upper, sole structure, and first strap portion meet. Additionally or alternatively, the second strap section may extend from a lateral side of the article of footwear (e.g., from a lateral midfoot or lateral forefoot area of the article of footwear), across the instep area of the article of footwear, around the medial ankle area of the article of footwear, and to a rear heel location where it engages the lock. This second strap portion can be fixed to the upper (e.g., to the first upper component and/or the second upper component) and/or the sole structure (and/or another footwear component) at the lateral midfoot and/or lateral forefoot area (e.g., by stitching, adhesive, mechanical connector(s), etc.), e.g., at a location where the upper, sole structure, and second strap portion meet. Articles of footwear according to this aspect of the invention may have any type of upper, foot-insertion opening, and/or closure system, including any of the uppers, foot-insertion openings, and/or closure systems described above and/or described below in more detail.

Articles of footwear in accordance with additional and/or other aspects of this invention may include:

(a) a first upper component (formed from one or more parts, e.g., an exterior upper component);

(b) a second upper component (formed from one or more parts, e.g., an interior upper component and/or a foot-containing bootie);

(c) a foot-insertion opening (which may include a closure system) defined by the first upper component, wherein the foot-insertion opening (and/or the closure system, if present) extends: (i) from a first side of an ankle-containing portion of the first upper component, (ii) around a rear heel or ankle area of the first upper component, (iii) along a second side of the ankle-containing portion of the first upper component, and (iv) to an instep-containing portion of the upper (in some embodiments: (a) the foot-insertion opening and/or the closure system may extend across an instep-containing portion of the first upper component and to a first side of the instep-containing portion of the first upper component, (b) the foot-insertion opening and/or the closure system may extend across a central longitudinal axis of the upper at a forefoot portion of the upper; and/or (c) the foot-insertion opening and/or the closure system may extend to a forefoot portion of the upper at or short of a central longitudinal axis of the upper at the forefoot portion of the upper (e.g., not across the central longitudinal axis of the upper at the forefoot portion of the upper);

(d) a first strap section extending between the first upper component and the second upper component and across (e.g., beneath) the instep-containing portion of the first upper component;

(e) a second strap section extending between the first upper component and the second upper component and across (e.g., beneath) the instep-containing portion of the first upper component;

(f) a sole structure engaged with at least one of the first upper component or the second upper component; and (g) a lock engaged with at least one of the first upper component, the second upper component, the first strap section, the second strap section, or the sole structure, e.g., at a rear heel area of any one or more of these components, wherein the lock releasably holds the at least one of the first strap section or the second strap section in a tightened condition (e.g., around a wearer's foot).

A closure system, e.g., including a track and in some examples a slider engaged with the track (e.g., a zipper or other slider based closure system, as described above) may be provided that extends along a length of the foot-insertion opening, wherein movement of the slider along the track changes the closure system (and changes the foot-insertion opening) between an open condition and a closed condition. Additionally or alternatively, this closure system, when present, may include one or more of: one or more buttons, one or more snaps, one or more hook-and-loop fasteners, one or more buckles, one or more securing straps, one or more pressure interlocking track structures (e.g., tracks that may be opened and closed without a slider, but by hand pressure or other pressure source), one or more ties, one or more magnets, etc., provided at one or more locations along the length of the foot-insertion opening. As another alternative or potential feature, this type of closure system may be omitted (e.g., and the foot-insertion opening may be held shut by an ankle strap (e.g., of the types described above and/or of the types described in more detail below) or other structure).

The article of footwear according to these examples/aspects of the invention also may include an ankle strap provided as part of or engaged with at least one of the first upper component or the second upper component (e.g., an ankle strap that extends across a central longitudinal axis of the article of footwear and/or upper and/or across the instep-containing portion of the first upper component and/or the second upper component). The ankle strap, when present, may include and/or engage a fastener that releasably holds (partially or fully) the foot-insertion opening (and/or a closure system when present) in a closed condition.

In these examples/aspects of the invention, the first strap section may extend along a first side of a heel-containing area of the second upper component and the second strap section may extend along a second side of the heel-containing area of the second upper component. In at least some examples of this invention, the first strap section may extend through the first upper component, e.g., at a first rear heel area of the first upper component, and/or the second strap section may extend through the first upper component, e.g., at the first rear heel area of the first upper component or at a second rear heel area of the first upper component. These strap section(s) may engage the lock at the rear heel area(s).

While the description above mentions that the "first side" of the article of footwear, upper, or other footwear components may be the lateral side and the "second side" of the article of footwear, upper, or other footwear components may be the medial side, the "first side" could be the medial side and the "second side" could be the lateral side, at least in some example structures in accordance with aspects of this invention.

More specific examples of structures and aspects of this invention now will be described with reference to the accompanying figures.

II. DETAILED DESCRIPTION OF FOOTWEAR AND FOOTWEAR COMPONENTS ACCORDING TO EXAMPLES OF THE INVENTION

FIGS. 2A-2D provide medial, lateral, front, and rear views, respectively, of an article of footwear 200 in accordance with at least some examples and aspects of this invention. This example article of footwear 200 is a hightop boot or basketball shoe. Aspects of this invention, however, also may be used in shoes for other events and/or other types of uses or activities. The article of footwear 200 includes an upper 202 and a sole structure 204 engaged with the upper 202. The upper 202 and sole structure 204 may be engaged together in any manner, including in manners conventionally known and used in the footwear arts (such as by adhesives or cements, by stitching or sewing, by mechanical connectors, etc.). The upper 202 also defines a foot-insertion opening 206 that allows the user's foot access to an interior foot-receiving chamber of the footwear 200. The foot-receiving chamber may be defined at least in part by the footwear upper 202, at least in part by the sole structure 204, and/or at least in part by other footwear components.

The sole structure 204 may be made from any material(s) and/or number of components without departing from this invention, including conventional materials and/or conventional components/number of components as are known and used in the footwear arts. As some more specific examples, the sole structure 204 may include one or more midsole components (e.g., for providing one or more of impact force attenuation, comfort for the wearer, etc.) and/or one or more outsole components (e.g., for providing one or more of wear resistance, traction, a ground contacting member, etc.). The midsole component(s), when present, may include one or more of: one or more polymeric foam material parts (e.g., made from polyurethane foam material(s), ethylvinylacetate foam material(s), etc.); one or more fluid-filled bladders; one or more mechanical shock absorbers; etc. The midsole component(s), if any, may be engaged with the upper, e.g., directly with one or more upper components, such as a strobel member, an exterior upper component, an interior upper component, a bootie component, etc. The outsole component(s), if any, may be made from conventional outsole materials, such as natural or synthetic leather, natural or synthetic rubber, thermoplastic polyurethanes, polyurethanes, ethylvinylacetate materials, or the like. The outsole component(s), if any, may be engaged with one or more midsole components, one or more upper components, and/or with another footwear component. As another alternative feature present in one or more embodiments, a single sole structure component or part may function both as an impact force attenuating component and a ground-contacting component for the article of footwear 200 (e.g., function as both a midsole component and an outsole component).

As shown in FIGS. 2A-2D, the upper 202 of this example article of footwear 200 includes one or more upper parts that define:

(a) an ankle-containing portion 210 having a first side (e.g., lateral side 210AL), a second side (e.g., medial side 210AM), and a rear portion 210AR; and (b) an instep-containing portion 220 having a first side (e.g., lateral side 2201L), a second side (e.g., medial side 2201M), and a central portion 2201C.

The upper 202 (and the part(s) defining the ankle-containing portion 210 and/or the part(s) defining the instep-containing portion 220) may be made from any material(s) and/or number of components without departing from this invention, including conventional materials and/or conventional components/number of components as are known and used in the footwear arts.

This example article of footwear 200 includes a closure system 230 engaged with the upper 202, and this closure system 230 is used to change the foot-insertion opening 206 (and the closure system 230) of the upper 202 between an open condition (in which the user can insert or remove his/her foot) and a closed condition (in which the upper 202 is secured to the wearer's foot). In this illustrated example, the closure system 230 includes a track 230T that extends from a first end 230A (e.g., an open end) located at a first side (e.g., the lateral side) of the ankle-containing portion 210AL of the upper 202 to a second end 230B (e.g., a closed end) located at a first side (e.g., the lateral side) of the instep-containing portion 220IL of the upper 202. In this manner, as shown in FIGS. 2A-2D, the track 230T may extend: (a) around a rear ankle area 210AR of the ankle-containing portion 210 of the upper 202, (b) along a second side (e.g., the medial side) 210AM of the ankle-containing portion 210 of the upper 202, and (c) across a central portion 220IC of the instep-containing portion 220 of the upper 202 (e.g., across a central longitudinal axis of the upper 202 at a location forward of the foot-insertion opening 206). The central portion 220IC of the instep-containing portion 220 of the upper 202 is located between (e.g., bridges and/or connects) the first side (e.g., lateral side) 220IL of the instep-containing portion 220 of the upper 202 and the second side (e.g., medial side) 220IM of the instep-containing portion 220 of the upper 202. The path on the upper 202 defined by the track 230T also may define all or some of the foot-insertion opening 206 of the upper 202/article of footwear 200.

A slider 230S is engaged with the track 230T in this example footwear 200 structure. The slider 230S is movable along the track 230T to change this example closure system 230 between an open condition (e.g., a foot-insertion or foot-removal condition) and a closed condition (e.g., a foot-securing condition). The track 230T and slider 230S may constitute a zipper type closure system or other slider based type closure system (e.g., an interlocking track structure with slider or the like). As another alternative or potential feature, the slider 230S could be omitted and the track 230T may constitute an interlocking track that can be closed by applying pressure to the interlocking track parts and opened by a separation/pulling force (e.g., akin to a closure track along re-sealable food storage bags). Additionally or alternatively, this closure system 230 may include one or more of: one or more buttons, one or more snaps, one or more hook-and-loop fasteners, one or more buckles, one or more securing straps (e.g., including an ankle strap), one or more ties, one or more magnets, etc., provided at one or more locations along the length of the foot-insertion opening 206 and/or the length of the closure system 230 track 230T (e.g., from first end 230A to second end 230B along track 230T).

FIGS. 2A through 2D further illustrate that this example article of footwear 200 includes an ankle strap 240, e.g., that extends around the front ankle covering portion 210AF and/or across a central instep-containing portion 220IC of the upper 202 to help secure the article of footwear 200 to a wearer's foot. In accordance with at least some examples of this invention, the ankle strap 240 may be engaged with the slider 230S of the closure system 230. The ankle strap 240 of this example includes and/or engages with a fastener to releasably secure to the upper 202. As a more specific example, the fastener may include an engagement element 240E that releasably engages a securing component 240S engaged with the upper 202, e.g., at the second side of the ankle-containing portion (e.g., the medial side 210AM). In this example, the ankle strap 240 releasably engages with the securing component 240S to change the ankle strap 240, the foot-insertion opening 206, and/or the overall closure system 230 between an open condition (in which the ankle strap 240 is disengaged from the securing component 240S, described in more detail in conjunction with FIGS. 3A-3E) and a closed condition (in which the ankle strap 240 is engaged with the securing component 240S, e.g., as shown in FIGS. 2A-2D). Any type of fastener may be used without departing from this invention, including one or more of: a combination of an engagement element 240E included with the ankle strap 240 and a securing component 240S engaged with the upper 202; one or more snaps; one or more buttons; one or more hook-and-loop fasteners; one or more buckles; one or more laces or ties; one or more magnets; or the like. In this specifically illustrated example, the fastener includes the combination of securing element 240E and its cooperating securing component 240S, which are structurally parts of a conventional releasable snap connector.

As further shown in FIGS. 2A-2D, in this example footwear structure 200, the ankle strap 240 extends from the first side 210AL of the ankle-containing portion 210 (e.g., the lateral side) of the upper 202 to the second side 210AM of the ankle-containing portion 210 (e.g., the medial side) when the foot-insertion opening 206, the closure system 230, and/or the strap 240 is/are in the closed condition. Additional details of this ankle strap 230, its engagement with the upper 202, and its transition between the open condition and the closed condition will be described in more detail in conjunction with FIGS. 3A-3E.

FIGS. 2A-2D illustrate additional example features of articles of footwear 200 and components thereof in accordance with at least some examples of this invention. For example, as shown in FIG. 2A, a portion of the track 230 at the second side 210AM of the ankle-containing portion 210 (e.g., the medial side) may be located a distance D1 of less than 1.5 inch (3.81 cm), and in some examples, less than 1.25 inch (3.18 cm), less than 1 inch (2.54 cm), or even less than 0.75 inch (1.91 cm), from at least a portion of the engagement element 240E (when the ankle strap 240 is secured) or its cooperating securing component 240S. Also, as shown in FIGS. 2A-2D, the engagement element 240E and/or its corresponding securing component 240S may be located between the track 230T and a top (e.g., top edge 206E) of the foot-insertion opening 206 of the upper 202. Additionally or alternatively, in at least some examples of this invention, a portion of the track 230T at the second side 210AM of the ankle-containing portion 210 (e.g., the medial side) may be located a distance D2 of less than 2.25 inches (5.72 cm), less than 2 inches (5.08 cm), less than 1.75 inch (4.45 cm), less than 1.5 inch (3.81 cm), or even less than 1.25 inch (3.18 cm) from a top (e.g., a top edge 206E) of the foot-insertion opening 206 of the upper 202.

As another or an alternative potential dimensional feature, as shown in FIG. 2D, in at least some examples of this invention, with the article of footwear 200 oriented on a horizontal base surface, a top of the rearmost ankle portion of the track 230T (and/or the entire rearmost ankle portion of the track 230T) may be located a distance D3 of less than 2 inches (5.08 cm), and in some examples, less than 1.75 inch (4.45 cm), less than 1.5 inch (3.81 cm), or even less than 1.25 inch (3.18 cm), from a rearmost top point or top edge 206E of the upper 202. In some examples, the distance D3 may be measured from a top of the track 230T at the rearmost heel location RH of the upper 202 to a rearmost top point or a rearmost top edge 206E of the foot-insertion opening 206 of the upper 202 at the rearmost heel location RH of the upper 202. In accordance with at least some examples of this invention, as shown in FIG. 2B, the first end 230A of the track 230 (e.g., the open end of the foot-insertion opening 206) may be located a distance D4 of less than 2 inches (5.08 cm), and in some examples, less than 1.75 inch (4.45 cm), less than 1.5 inch (3.81 cm), or even less than 1.25 inch (3.18 cm), from a top (e.g., the top edge 206E) of the foot-insertion opening 206 of the upper 202, e.g., when the upper 202 and foot-insertion opening 206 are in a closed condition and the footwear 200 is supported on a horizontal base surface in an unloaded condition.

In accordance with at least some examples of this invention, the first end 230A of the track 230 and/or the foot-insertion opening 206 may be located at the first side 210AL of the ankle-containing portion 210 of the upper 202, for example, at a location along the longitudinal direction L of the article of footwear 200 between parallel planes located at P=0.25L and P=0.45L, and in some examples, between parallel planes located at P=0.3L and P=0.4L (with P=0.34L shown in FIG. 2B). Additionally or alternatively, the foot-insertion opening 206 and/or the track 230T may extend from the first end 230A rearward to a rearmost opening/track location PT, e.g., located along the longitudinal direction L of the article of footwear 200 between parallel planes located at P=0L and P=0.2L, and in some examples, between parallel planes located at P=0.05L and P=0.15L (with P=0.09L shown in FIG. 2B). Additionally or alternatively, after extending around the wearer's ankle, the foot-insertion opening 206 and/or the track 230T may extend to its other end 230B (or to a forwardmost point), e.g., located along the longitudinal direction L of the article of footwear 200 between parallel planes located at P=0.6L and P=0.85L, and in some examples, between parallel planes located at P=0.65L and P=0.8L (with P=0.74L shown in FIG. 2B). As described above, the second end 230B of track 230T (and/or the foot-insertion opening 206) in at least some examples of this invention is located on the first side 2201L of the instep-containing portion 220 of the upper 202 (e.g., the same side of the upper 202 at which the first end 230A of the track 230T and/or foot-insertion opening 206 is/are located). Additionally or alternatively, as shown in FIG. 2A, at least a portion of the fastener (e.g., 240E and/or 240S) or the securing location for the ankle strap 240 to the upper 202 (if any) may be located on the second side 210AM of the ankle-containing portion 210 of the upper 202, e.g., located along the longitudinal direction L of the article of footwear 200 between parallel planes located at P=0.2L and P=0.45L, and in some examples, between parallel planes located at P=0.25L and P=0.4L (with P=0.32L shown in FIG. 2A). Other arrangements and/or locations of any one or more of these various parts and/or features may be used, however, without departing from this invention and/or articles of footwear in accordance with some examples of this invention may have any one or more of these locations features and/or characteristics. The plane locations described above are determined in the manner described above in conjunction with FIG. 1.

FIGS. 2A-2D further illustrate that the upper 202 of this example article of footwear 200 includes a heel support 250 that extends at least around the heel area of the upper 202. The heel support 250 may function, at least in part, as a conventional heel counter type structure or other heel support structure for the article of footwear 200. In this illustrated example, the heel support 250 of the upper 202 includes a lock 330, which will be described in more detail below, e.g., in conjunction with FIGS. 3A through 4G.

Additional or alternative potential features of articles of footwear and uppers in accordance with at least some examples of this invention, e.g., including the article of footwear 200 and upper 202 examples of FIGS. 2A-2D, will be described below in conjunction with FIGS. 3A-3E. In addition to showing potential and example structural features of such articles of footwear and uppers, FIGS. 3A-3E further show one manner in which such articles of footwear and uppers, including the article of footwear 200, the upper 202, the closure system 230, and the strap 240 of FIGS. 2A-2D, can be changed between the open condition (e.g., a foot-insertion or foot-removal configuration) and the closed condition (e.g., a foot-securing configuration). When the same reference numbers are used in FIGS. 3A-3E as those used in FIGS. 2A-2D, these reference numbers represent the same or similar parts/structures (and these parts/structures in FIGS. 3A-3E may have the same alternatives and/or features as their corresponding parts as described above in conjunction with FIGS. 2A-2D). A repetitive description of these same or similar parts/structures will be omitted.

As shown in FIGS. 3A-3E, this example article of footwear 300 includes a first upper component 302A (e.g., an exterior upper component) and a second upper component 302B (e.g., an interior upper component). These upper components 302A and 302B may be fixed together or may be separable from one another. In this example article of footwear 300, a foot-insertion opening 206 is at least in part defined by the first upper component 302A. In this specifically illustrated example article of footwear 300, the foot-insertion opening 206 extends: (a) from a first side 210AL of an ankle-containing portion 210 of the first upper component 302A, (b) around a rear heel or ankle area 210AR of the first upper component 302A, (c) along a second side 210AM of the ankle-containing portion 210 of the first upper component 302A, (d) across an instep-containing portion 220 of the first upper component 302A, and (e) to a first side 2201L of the instep-containing portion 220 of the first upper component 302A. One or more of the above-noted portions of the foot-insertion opening 206 described in items (a) through (e) above also may include a closure system 230, such as a track 230T and slider 230S or other types of closure systems, as described in more detail above. The top edge 206E of the first upper component 302A also forms a portion of the foot-insertion opening 206 of this example. This top edge 206E may include elastic or other material, e.g., to form fit and/or securely engage with a wearer's ankle/leg. A sole structure 204 may be engaged with at least one of the first upper component 302A and/or the second upper component 302B (or another footwear component part).

The article of footwear 300 shown in FIGS. 3A-3E further may include an ankle strap 240 and/or a fastener (e.g., 240E/240S) for the ankle strap 240, e.g., having any of the features and/or alternatives for these components as described above for FIGS. 2A-2D.

As shown in FIGS. 2A-3D, the foot-insertion opening 206 and/or the closure system 230 may be interchangeable between: (a) a closed condition (e.g., a foot-securing condition as shown in FIGS. 2A-2D) in which the footwear 200, 300 may be secured to a wearer's foot and (b) an open condition (e.g., a foot-insertion or foot-removal condition as most completely shown in FIG. 3C) in which the foot may be inserted or removed from the upper 202/302A. The ankle-containing portion 210 of the upper 202/302A (which may be formed from one or more parts) may constitute a "flap" of material or other flexible component that wraps around and releasably secures around the wearer's foot/ankle (e.g., using the closure system 230 and/or ankle strap 240).

As best seen by a comparison of FIGS. 2B and 3A, the ankle-containing portion 210 of these example uppers 202/302A includes a first end 310A that meets (and may overlap with) a second end 310B when the ankle-containing portion 210 of the upper 202/302A is in the closed condition. These ends 310A/310B may define an ankle-wrapping portion of this example upper 202/302A. In the example articles of footwear 200/300 shown in FIGS. 2A-3E, the first ankle-wrapping end 310A overlaps with the second ankle-wrapping end 310B when the ankle-containing portion 210 of the upper 202/302A is in the closed condition. In some footwear structures, a fastener could be provided at one or both of first ankle-wrapping end 310A and/or second ankle-wrapping end 310B to secure these ends 310A/310B together. Such fasteners may include one or more of: one or more snaps, one or more buttons, one or more hook-and-loop fasteners, one or more buckles, one or more laces or ties, one or more magnetic connectors/fasteners, or the like. In the illustrated example, however, no fasteners are included at these two ends 310A/310B, but the ends 310A/310B simply overlap when in the closed configuration. As shown in FIG. 3A, with the ankle-covering portion 210 oriented in the closed position (or closing) and with the article of footwear 300 supported on a horizontal support surface, the second ankle-wrapping end 310B of the ankle-containing portion 210 vertically aligns with or vertically overlaps with the first end 230A of the track 230T (and/or the end of the foot-insertion opening 206 vertically aligns with or vertically overlaps with the second ankle-wrapping end 310B). In this manner, the top of the ankle-covering portion 210 of the upper component 302A will completely surround the wearer's ankle/leg when the foot-insertion opening 206 and/or closure system 230 (when present) is fully closed (e.g., when the slider 230S is at the end 230A of the track 230T).

As another possibility, rather than overlap, the two ends 310A/310B may abut one another or lie within close proximity to one another (the term "close proximity" as used herein in this specific context means at least some portion of first ankle-wrapping end 310A is located within 1 inch (2.54 cm) of at least some portion of second ankle-wrapping end 310B). Additionally or alternatively, the degree of overlap or separation of the ends 310A/310B may depend, at least in part, on the circumference of the wearer's leg, the degree of stretch on elastic in the top edge 206E (if any), and/or a user's desired degree of tightness for the top edge 206E of the foot-insertion opening 206 around his/her leg.

The second upper component 302B (e.g., an "interior" upper component) of the upper of this example article of footwear 300 now will be described in more detail. As shown in FIGS. 3A and 3C-3E, in this illustrated example, the second upper component 302B constitutes a bootie that at least partially defines an interior chamber 308 for receiving a wearer's foot. The second upper component 302B may completely or partially define the interior chamber 308, and it may be fully or partially contained within/received in the first upper component 302A (which may constitute an exterior upper component). Access to the interior chamber 308 is provided by a foot-insertion opening 306 defined by the second upper component 302B. As shown by FIG. 3B, the second upper component 302B may be completely concealed when the first upper component 302A, the foot-insertion opening 206, and/or the closure system 230 is/are in the closed condition. If desired, however, some portion of second upper component 302B could be visible and/or exposed when the first upper component 302A, the foot-insertion opening 206, and/or the closure system 230 is/are in the closed condition.

This illustrated example footwear 300 structure includes additional structure to tighten and secure the second upper component 302B to a wearer's foot. In this specifically illustrated example, as shown in FIGS. 3D-3E (and can also be included in the example of FIGS. 2A-2D), the article of footwear 300 includes a first strap section 320A extending between the first upper component 302A and the second upper component 302B and across (and beneath) a central instep-containing portion 2201C of the first upper component 302A. This example strap section 320A extends from the lateral forefoot and/or lateral instep-containing portion 2201L of the overall upper to the medial ankle-containing portion 210AM of the overall upper. The article of footwear 300 further includes a second strap section 320B extending between the first upper component 302A and the second upper component 302B and across (and beneath) the central instep-containing portion 2201C of the first upper component 302A. This example strap section 320B extends from the medial forefoot and/or medial instep-containing portion 220IM of the overall upper to the lateral ankle-containing portion 210AL of the overall upper. As best shown in FIG. 3E, in this illustrated example, the first strap section 320A crosses the second strap section 320B at a location forward of the foot-receiving opening 306 of the interior upper component 302B (e.g., a foot-receiving bootie). The forward ends of strap sections 320A/320B may be permanently or releasably engaged with the footwear 300 upper and/or sole structure 204 at the medial and/or lateral forefoot area(s) and/or at the medial and/or lateral midfoot area(s) of the article of footwear 300 (e.g., by one or more of stitching, adhesive, mechanical connector(s), etc.).

Figure 3C:
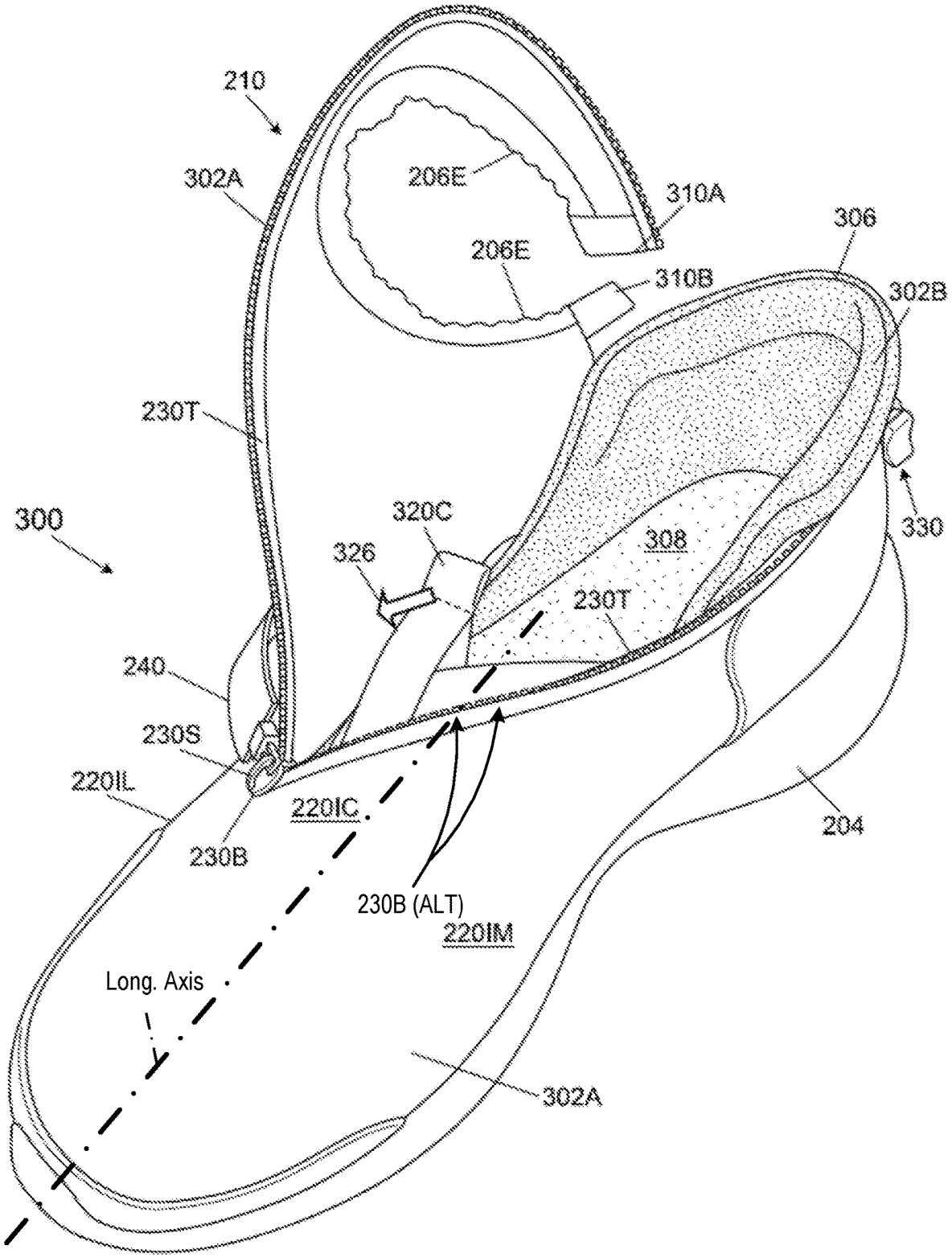
Figure 3D:
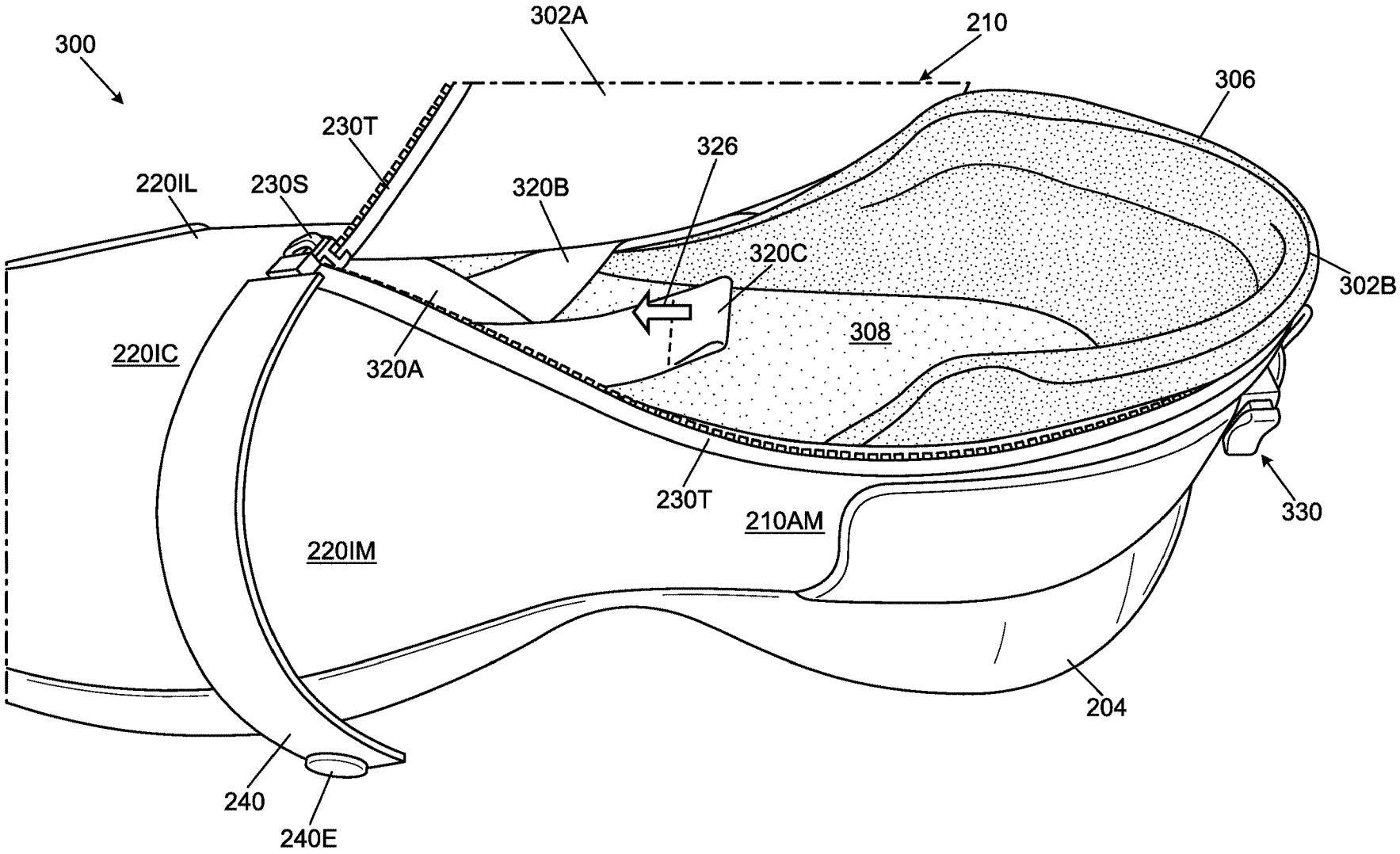
Figure 3E:
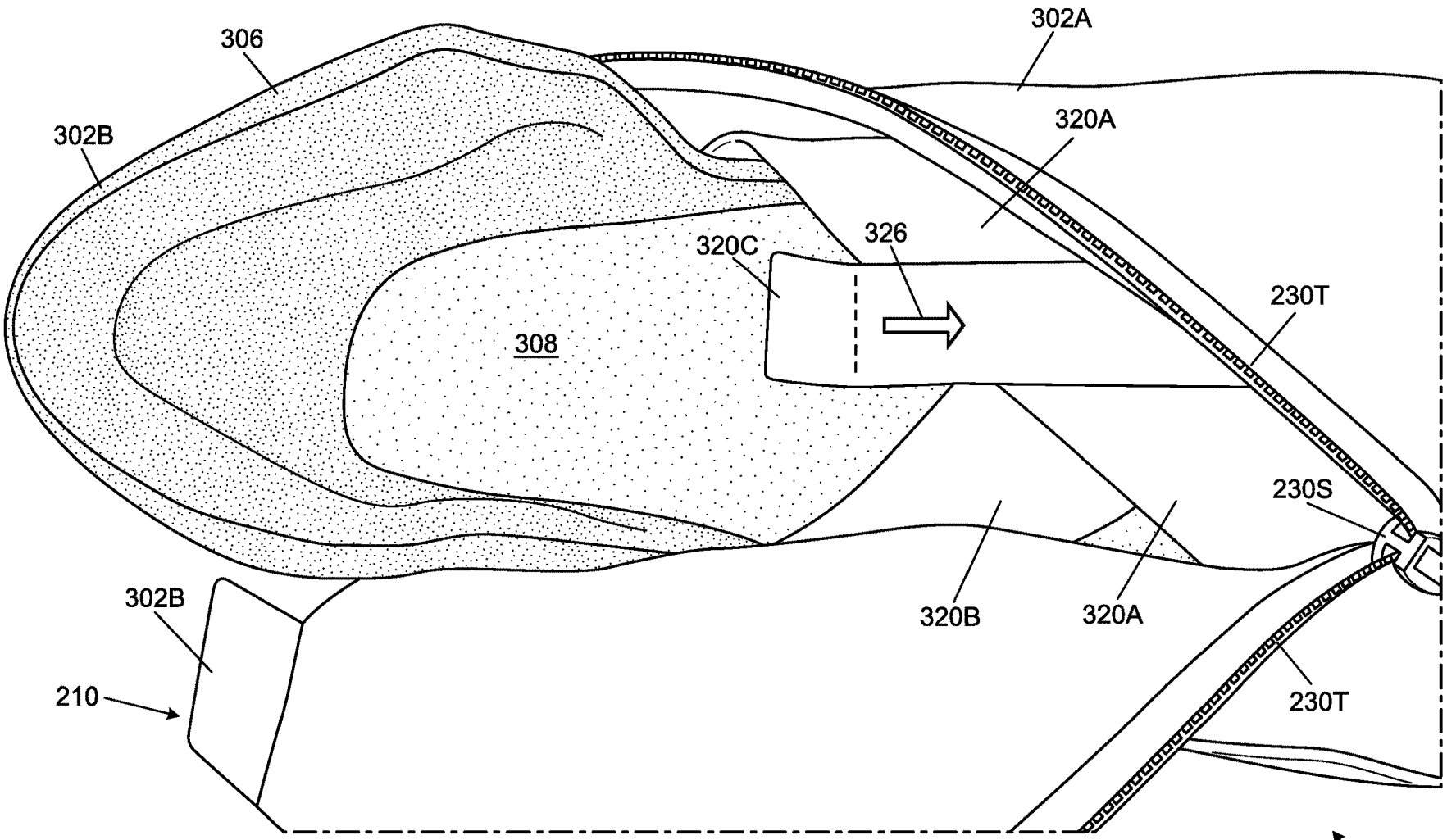
Figure 4A:
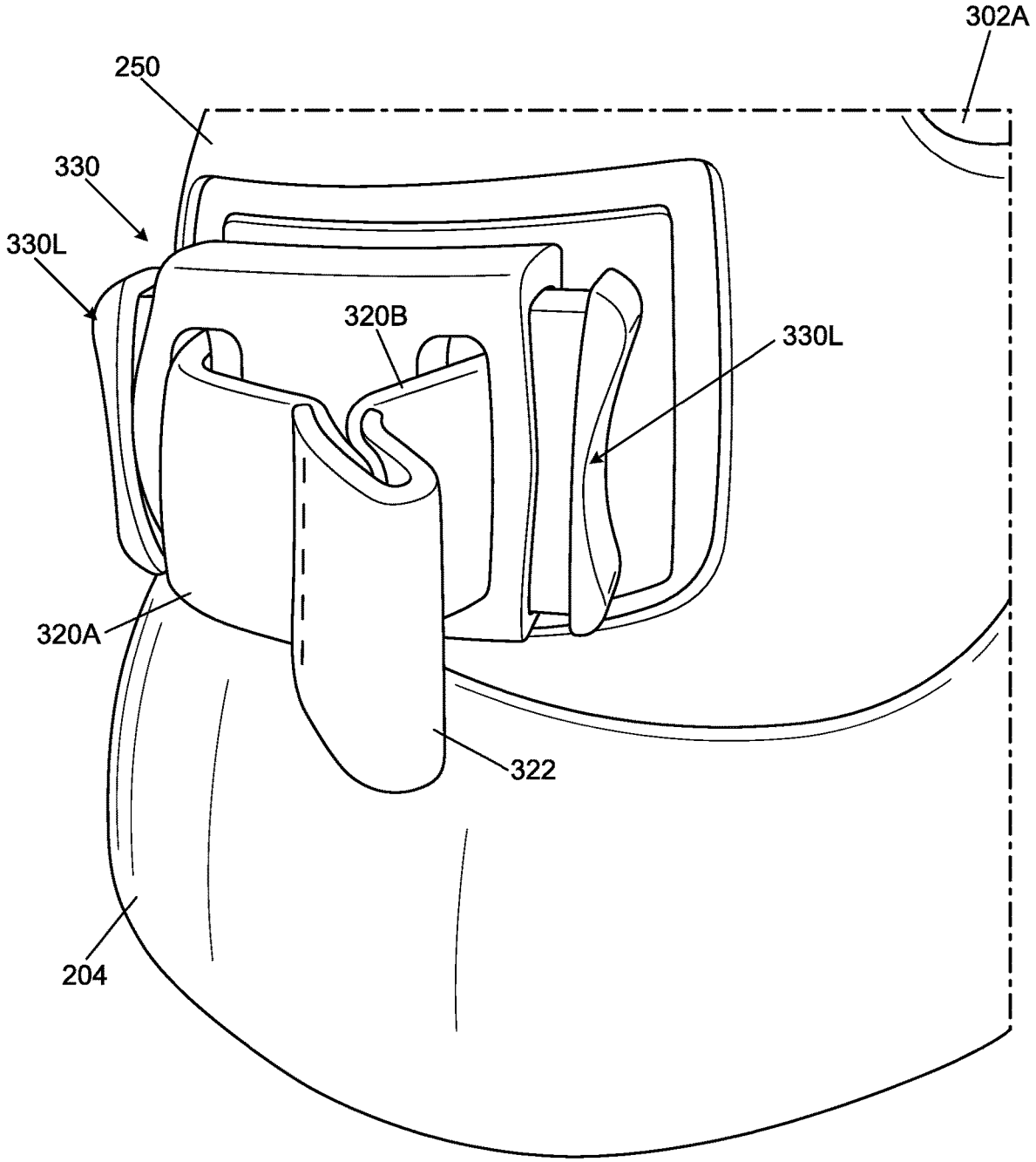
FIGS. 4A-4G provide various views of a strap lock that may be included in articles of footwear in accordance with at least some examples of this invention.
Figure 4B:
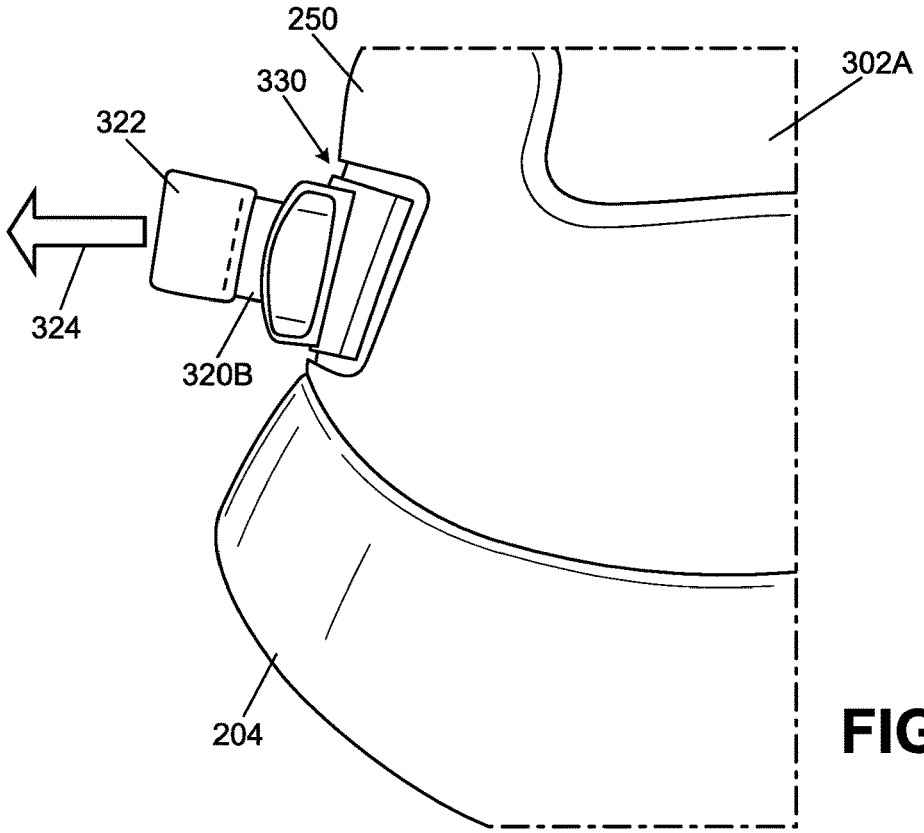
Figure 4C:
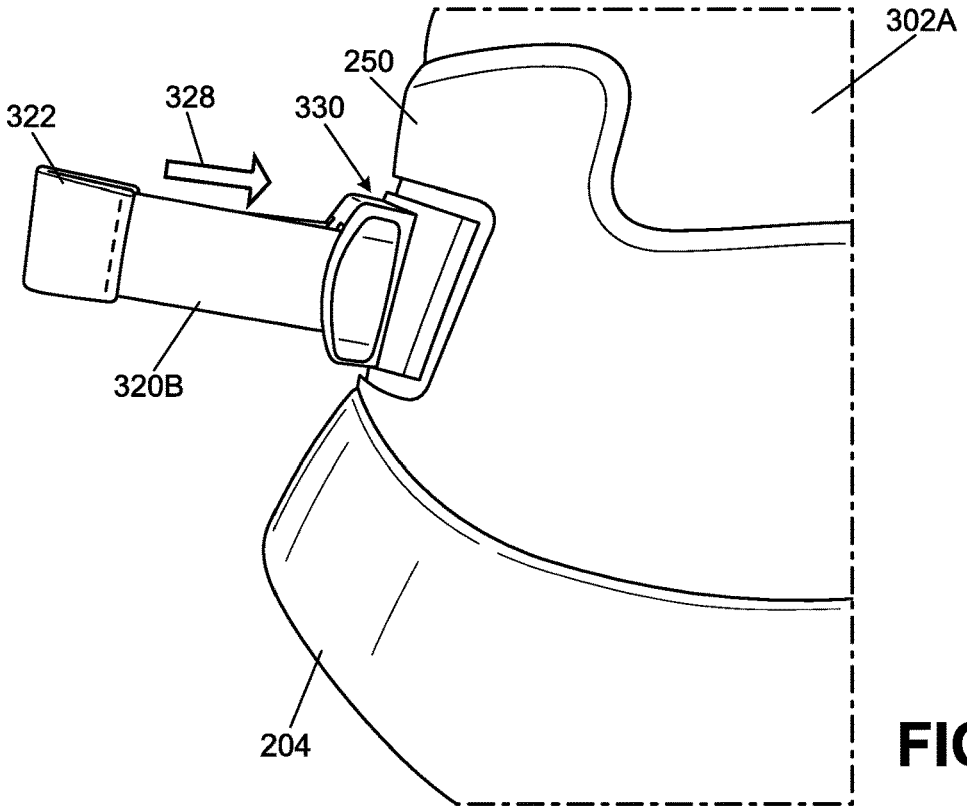
Figure 4E:
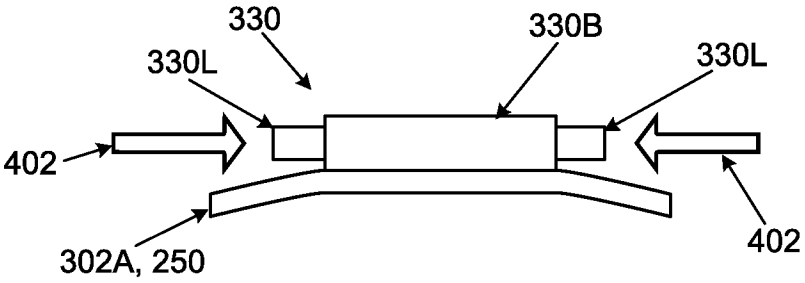
Figure 4G:
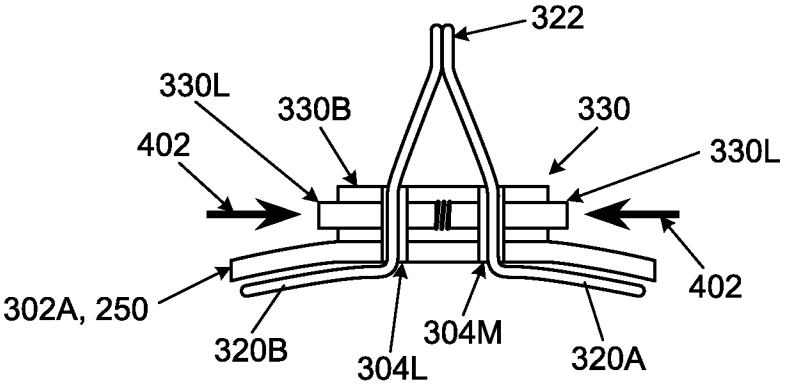
Figure 4D:
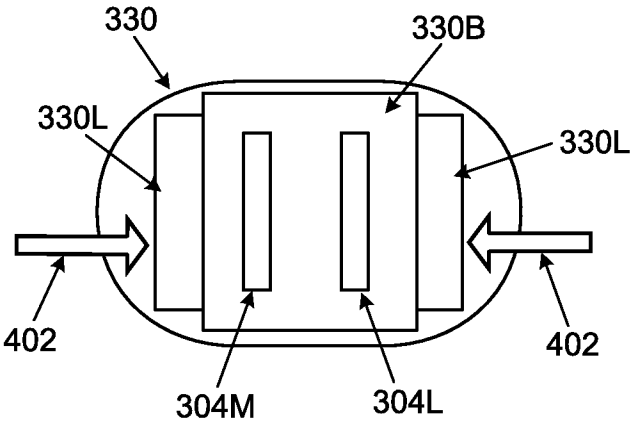
Figure 4F:
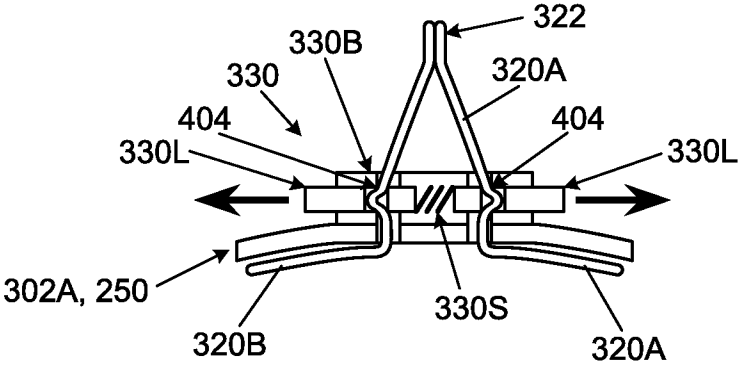

With reference to FIGS. 3A-4G, the first strap section 320A extends along the medial ankle-containing portion 210AM inside the first upper component 302A and outside the second upper component 302B and exits from this intermediate location to an area outside the first upper component 302A at a rear heel area of the first upper component 302A (e.g., through an opening 304M provided at the rear heel area, e.g., an opening 304M through heel support 250 as shown in FIGS. 4D, 4F, and 4G). Similarly, the second strap section 320B extends along the lateral ankle-containing portion 210AL inside the first upper component 302A and outside the second upper component 302B and exits from this intermediate location to an area outside the first upper component 302A at a rear heel area of the first upper component 302A (e.g., through an opening 304L provided at the rear heel area, e.g., an opening 304L through heel support 250 as shown in FIGS. 4D, 4F, and 4G). The second strap section 320B may extend outside of first upper component 302A from its intermediate location between the first upper component 302A and the second upper component 302B through the same opening in upper component 302A and/or heel support 250 as the first strap section 320A or through a separate and independent opening (e.g., openings 304M and 304L in FIGS. 4D, 4F, and 4G and described above may be a single opening through which both strap sections 320A-320B extend).

The rear heel area of the first upper component 302A in this illustrated example (and in the example of FIGS. 2A-2D) includes a lock 330 for engaging one or both strap sections 320A/320B. The lock 330 may be engaged with at least one of the first upper component 302A, the second upper component 302B, the first strap section 320A, the second strap section 320B, and/or the sole structure 204 of the article of footwear. This lock 330 releasably holds at least one of the first strap section 320A and the second strap section 320B around the wearer's foot, e.g., in a tightened condition. In the illustrated examples, the lock 330 engages both the first strap section 320A and the second strap section 320B. The strap sections 320A/320B of this example are joined together at their free ends by pull tab 322. The pull tab 322 can be formed of a separate part to which the free ends of strap sections 320A/320B are engaged (e.g., by sewing, adhesives, mechanical connectors, etc.) and/or the pull tab 322 can be formed by securing the free ends of strap sections 320A/320B together without a separate part (e.g., by sewing, adhesives, mechanical connectors, etc. engaging the strap section free ends together).

As shown by a comparison of FIGS. 4B and 4C, the first strap section 320A and the second strap section 320B can be tightened around the wearer's foot by pulling pull tab 322 outward. This action is shown by arrow 324 in FIG. 4B, and it shortens the length of both the first strap section 320A and the second strap section 320B in the interior of the upper (e.g., in the volume between the first upper component 302A and the second upper component 302B) thereby tightening the strap sections 320A/320B around a wearer's foot. This action also is shown in sequence by the arrangement shown in FIG. 4B changing to the arrangement shown in FIG. 4C. Once at a user's desired degree of tightness, the lock 330 can be activated (examples of which will be described in more detail below) to hold the strap section(s) 320A/320B at a fixed location with respect to the lock 330 (e.g., as shown in FIG. 4C). The strap sections 320A/320B can be tightened before or after the first upper component 302A is secured around the wearer's foot. The first upper component 302A may be secured around the wearer's foot, for example: (a) by sliding slider 230S along track 230T from the second end 230B to the first end 230A or otherwise closing the closure system 230 and/or (b) by securing the ankle strap 240 around the wearer's ankle/leg by engaging fastener element 240E with cooperating fastener element 240S or otherwise securing a fastener.

As shown in FIGS. 3C-3E, in this illustrated example article of footwear 300, the first strap section 320A and the second strap section 320B engage an additional component, e.g., an additional strap section 320C, and this additional component is used to loosen the first strap section 320A and/or the second strap section 320B from its/their tightened condition around the wearer's foot. More specifically, in this example, the loosening component (e.g., strap section 320C) forms a loop, and the first strap section 320A and the second strap section 320B pass through this loop. The loosening component (e.g., strap section 320C) loop is located at a central instep-covering portion of the overall upper (e.g., between the first upper component 302A and the second upper component 302B) and/or forward of the foot-insertion opening 306 of the second upper component 302B, e.g., as shown in FIG. 3E. The loosening component need not constitute a strap portion. As other examples, it may constitute a pull tab, a ring, a hardware element, or any other type of structure that will allow a user to pull one or more of the strap portions 320A and/or 320B upward from the wearer's foot and/or forward and away from the wearer's leg/ankle to loosen them from the tightened condition.

The footwear 300 removal process now will be described in more detail with reference to FIGS. 3A-3E, e.g., starting with a secured shoe as shown in FIGS. 2A-2D. First, the ankle strap 240 is loosened, e.g., by disengaging the ankle strap fastener (e.g., by disengaging ankle strap fastener element 240E from the upper based fastener component 240S). Then the foot-insertion opening 206 of the first upper component 302A is opened by unwrapping the ankle-containing flap 210 of the first upper component 302A from around the wearer's leg. If the article of footwear 300 is so equipped, this action may require moving slider 230S along track 230T from the first end 230A to the second end 230B (or otherwise disengaging any present type of closure system for foot-receiving opening 206). The lock 330 then may be unlocked, and the wearer then may pull the loosening component (e.g., strap section 320C) forward, e.g., as shown by arrow 326 in FIGS. 3C-3E. By pulling the loosening component (strap section 320C) forward, this also pulls strap sections 320A and 320B forward and pulls the exposed strap sections 320A/320B at the rear heel area inward (as shown by arrow 328 in FIG. 4C and as also shown in sequence by the arrangement shown in FIG. 4C changing to the arrangement shown in FIG. 4B). Once the first strap section 320A and the second strap section 320B are adequately loosened, the wearer's foot can be removed from the interior chamber 308 through foot-insertion opening 306 and foot-insertion opening 206. A separate loosening component (e.g., strap section 320C) can be omitted and the strap section(s) 320A and/or 320B can be loosened by pulling them back into the upper. The above noted steps also may take place in a different order and/or some steps may occur simultaneously.

Any type of lock 330 structure may be provided without departing from this invention. In this specifically illustrated example, the lock 330 includes a base 330B with one or more openings defined through it and through which the strap sections 320A and 320B extend (e.g., aligned with or included as part of the openings 304L and 304M in the upper component 302A/heel support 250). A spring-loaded lock 330L may be engaged with the base 330B in a manner so that the spring-loaded lock 330L can slide inward and outward with respect to the base 330B. As shown in FIG. 4F, when the spring 330S of the spring-loaded lock 330L is in a "relaxed" or "extended" condition, at least one of the first strap section 320A and/or the second strap section 320B is "pinched" between two (or more) bearing surfaces 404 to hold the strap section(s) 320A/320B in place with respect to at least some portion of the lock 330 (e.g., the lock base 330B) and to hold the strap section(s) 320A/320B at the tightened condition. In the "relaxed" or "extended" condition of this specific example, at least some portion of the opening(s) 304L and/or 304M are "closed off" to pinch the strap sections 320A/320B between the bearing surfaces 404 of the lock 330L and the base 330 and prevent relative movement of: (a) the strap section(s) 320A/320B with respect to (b) the lock base 330B, the upper component 302A, the upper component 302B, and/or the heel support 250. Spring 330S biases the lock 330L into the "relaxed" or locked configuration of FIG. 4F, in this illustrated example lock 330 structure.

On the other hand, as shown in FIGS. 4D, 4E, and 4G, when the spring 330S of the spring-loaded lock 330L is in a "compressed" condition (e.g., when the user pushes the opposite ends of lock 330L inward as shown by arrows 402 with sufficient force to overcome the biasing force of spring 330S), at least one of the first strap section 320A and/or the second strap section 320B will no longer be "pinched" between two bearing surfaces 404. This "compressed" lock 330 condition opens up at least one of the openings 304L/304M and allows the strap section(s) 320A/320B to move with respect to at least some portion of the lock 330 (e.g., the lock base 330B). This compressed lock 330 condition also allows the strap section(s) 320A/320B to be tightened or loosened, as desired by a user. In the "compressed" condition, at least some portion of the opening(s) 304L and/or 304M are "opened up" to allow easy and relative movement of the strap section(s) 320A/320B with respect to the lock base 330B, the upper component 302A, the upper component 302B, and/or the heel support 250.

Many variations in the strap section(s), lock 330 structure, and/or different types of lock structures and locking mechanisms may be provided without departing from this invention. As one example, the two strap sections 320A and 320B may constitute portions of a single continuous strap. Additionally or alternatively, only one of the strap sections 320A or 320B might engage a lock (whether the strap sections 320A/320B constitute part of one strap or two separate strap), and the other strap section could be fixed with respect to the footwear upper (e.g., to allow only one strap section to be tightened or loosened, to allow tightening or loosening of one strap section with the lock to tighten or loosen both strap sections (when the two strap sections are part of a single, continuous strap), etc.). Separate locks may be provided for each strap section 320A, 320B. As another example, one or more locks may be provided at other locations on the footwear 300 structure, such as at one or more of: at a lateral heel and/or lateral ankle side of the upper and/or sole structure, at the medial heel and/or medial ankle side of the upper and/or sole structure, at a top instep-containing area 2201C of the upper, etc.

Other types of locks may include, for example, one or more of: a ratcheted take-up reel that engages one or more of the strap sections 320A/320B (e.g., in a rotary manner); one or more clamps (e.g., that prevents the strap section(s) from moving inward through opening(s) 304L/304M); one or more clips (e.g., that prevents the strap section(s) from moving inward through opening(s) 304L/304M); one or more buckles; one or more buttons; one or more snaps; one or more retaining elements; etc.

While the foot-insertion opening 206 and the track 230T are described above and shown in FIGS. 2A-3E as extending across the central instep-containing portion 2201C of the upper 202 from the second side of the instep-containing portion (e.g., 2201M) to the first side of the instep containing portion (e.g., 2201L) (e.g., across a central longitudinal axis of the upper at a forefoot portion of the upper), these features are not required in all embodiments of the present invention.

Rather, in some embodiments of the invention, as illustrated by arrows 230B (ALT) in FIG. 3C, the foot-insertion opening 206 of the upper 202 and/or the track 230T may extend: (i) from a first side of an ankle-containing portion (e.g., 210AL) of the upper 202, (ii) around a rear heel or ankle area (e.g., 210AR) of the upper 202, (iii) along a second side of the ankle-containing portion (e.g., 210AM) of the upper 202, and (iv) to an instep-containing portion of the upper 202. In at least some embodiments according to this aspect of the invention, the end of the foot-insertion opening 206 and/or the closed end 230B of the track 230T may be located at the forefoot portion of the upper at or at a location short of a central longitudinal axis (Long. Axis, FIG. 3C) of the upper 202 at the forefoot portion of the upper 202 (e.g., and not across the central longitudinal axis (Long. Axis) of the upper 202 at the forefoot portion of the upper 202).

Figure 5A:
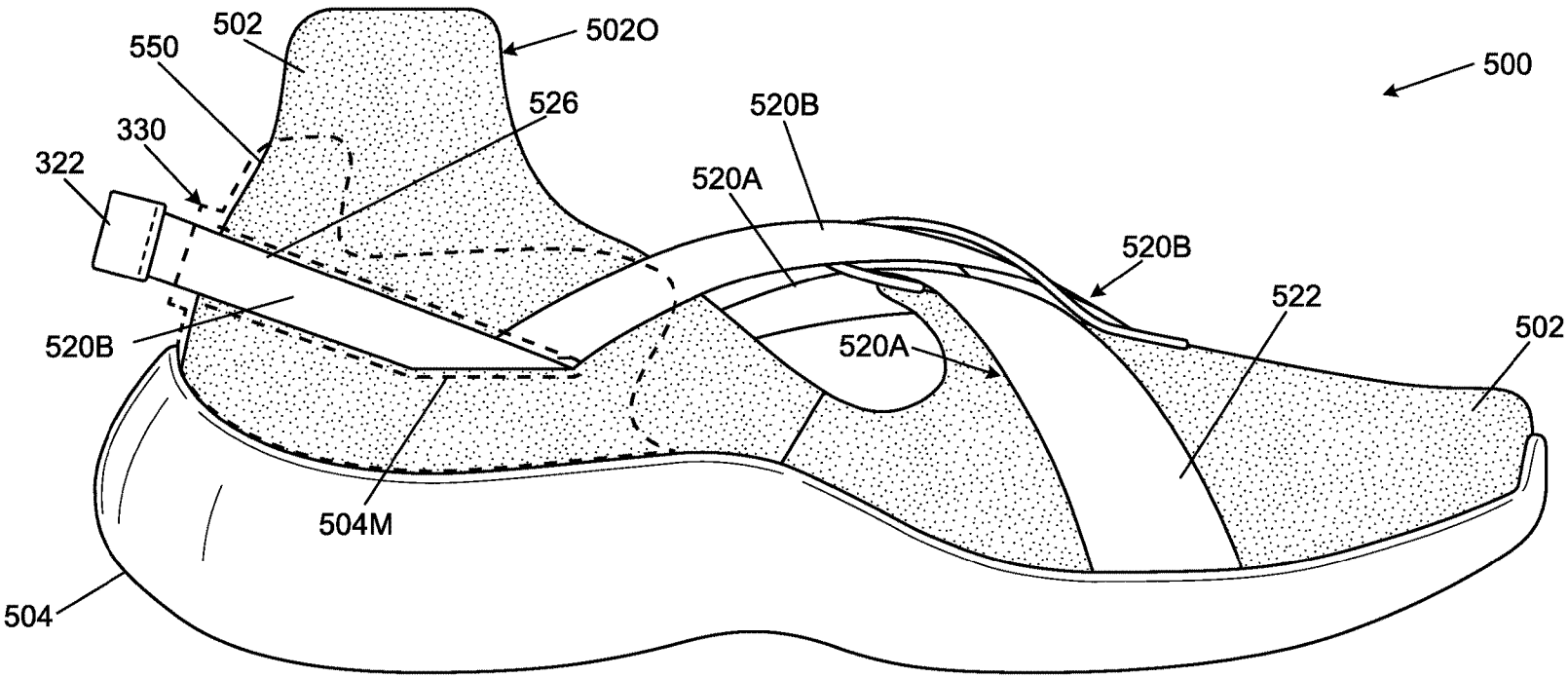
FIGS. 5A and 5B provide various views showing features of a strap and articles of footwear in accordance with at least some examples of this invention.
Figure 5B:
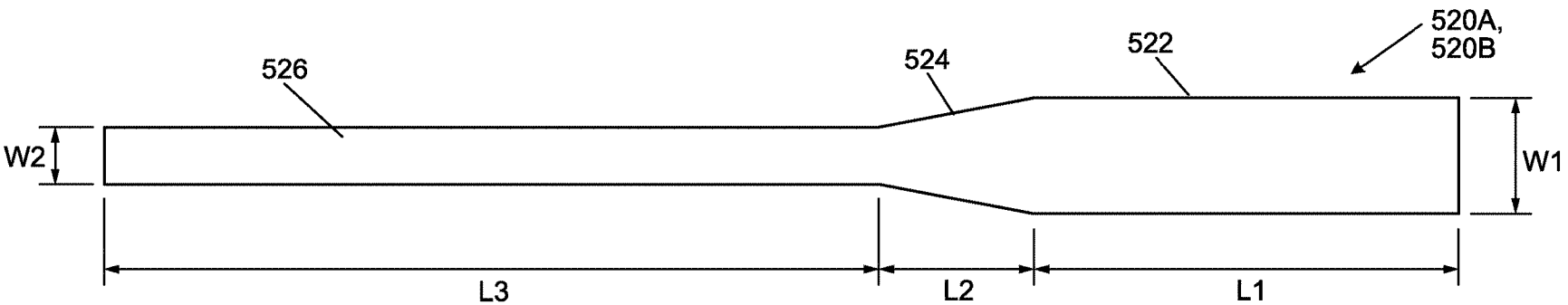

FIGS. 5A and 5B illustrate another example and/or additional details of an article of footwear 500, a first upper component 502 (which may constitute an interior upper component fit into or at least partially contained in an exterior upper component), and/or strap portions 520A/520B in accordance with at least some examples of this invention. When the same reference number is used in FIGS. 5A and 5B as used in other figures, that reference number refers to the same or similar part(s) as those described above, including any of the various alternatives, features, and/or variations described above. The strap portions 520A and 520B, the first upper component 502, and/or the relative arrangement of these parts as described in more detail below in conjunction with FIGS. 5A and 5B also could be used in the various embodiments of the invention described above in conjunction with FIGS. 2A through 4G.

This example footwear 500 structure includes at least a first upper component 502, a second upper component 550, and a sole structure 504 engaged with at least one of the first upper component 502 and/or the second upper component 550. The first upper component 502 is at least partially contained in the second upper component 550 in this example footwear structure 500. In an alternative embodiment, the first upper component 502 is fully contained in the second upper component 550. In this illustrated example, the strap portions 520A and 520B are provided as separate straps that are engaged at their free ends, e.g., by pull tab 322, e.g., in any manner as described above for strap sections 320A/320B. First strap section 520A extends from a medial side of the article of footwear 500 (e.g., from a medial midfoot or medial forefoot area of the article of footwear 500), across the instep area of the article of footwear 500, inside second upper component 550 and between second upper component 550 and first upper component 502, through an opening at the lateral heel side area of the second upper component 550 (to the outside of second upper component 550), along the outside of the lateral heel side area of the second upper component 550, to the lock 330 and pull tab 322. The first strap portion 520A can be fixed to the first upper component 502 and/or the sole structure 504 (and/or another footwear component) at the medial midfoot and/or medial forefoot area (e.g., by stitching, adhesive, mechanical connector(s), etc.), e.g., at a location where the first upper component 502, sole structure 504, and first strap portion 520A meet.

Similarly, second strap section 520B extends from a lateral side of the article of footwear 500 (e.g., from a lateral midfoot or lateral forefoot area of the article of footwear 500), across the instep area of the article of footwear 500, inside second upper component 550 and between second upper component 550 and first upper component 502, through an opening 504M at the medial heel side area of the second upper component 550 (to the outside of second upper component 550), along the outside of the medial heel side area of the second upper component 550, to the lock 330 and pull tab 322. The second strap portion 520B can be fixed to the first upper component 502 and/or the sole structure 504 (and/or another footwear component) at the lateral midfoot and/or lateral forefoot area (e.g., by stitching, adhesive, mechanical connector(s), etc.), e.g., at a location where the first upper component 502, sole structure 504, and second strap portion 520B meet. The lateral side of the second upper component 550 may have an opening like opening 504M shown on the medial side in FIG. 5A, and the first strap portion 520A may extend through this lateral side opening to the outside of the second upper component 550, as described above. The two strap portions 520A/520B cross one another at an instep area of the article of footwear 500, e.g., in front of and/or above any foot-receiving opening 5020 of upper component 502.

First upper component 502 and/or second upper component 550 may be located at least partially inside another upper component (not shown in FIG. 5A, but potentially like upper component 302A), and the lock 330 may be engaged with that additional upper component. Additionally or alternatively, the lock 330 may be engaged with the second upper component 550 and/or the first upper component 502. In some examples, the second upper component 550 may constitute a heel support component (e.g., like heel support 250 and/or a heel counter) and/or may be an exterior component of the article of footwear 500 (e.g., like a heel counter). Alternatively, the first upper component 502 may have another upper component at least partially (or even fully) contained within it.

FIG. 5B illustrates some additional details of the strap sections 520A, 520B that may be provided in at least some examples of this invention. As shown, the strap sections 520A, 520B of this example include a wider forefoot and/or instep section 522 (e.g., having width W1), a tapered section 524, and a narrower midfoot and/or heel/ankle section 526 (e.g., having a width W2). The tapered section 524 may taper in width from W1 to W2. The wider forefoot and/or instep section 522 has a longitudinal length L1, the tapered section 524 has a longitudinal length L2, and the narrower midfoot and/or heel/ankle section 526 has a longitudinal length L3. The strap sections 520A, 520B may have any one or more of the following dimensional features:

$$W1=1.2\times W2 \text{ to } 3\times W2$$

W1=from 20 mm to 50 mm, and in some examples 30 mm
W2=10 mm to 25 mm, and in some examples 15 mm $$L1=0.5\times L3 \text{ to } 1.5\times L3$$

$$L1=0.65\times L3 \text{ to } 0.9\times L3$$

$$L1=2\times L2 \text{ to } 6\times L2$$

$$L1=3\times L2 \text{ to } 5\times L2$$

$$L3=3\times L2 \text{ to } 8\times L2$$

$$L3=4\times L2 \text{ to } 6\times L2$$

$$L1+L2+L3=10\times W1 \text{ to } 16\times W1$$

$$L1+L2+L3=20\times W2 \text{ to } 32\times W2$$

L1=75 mm to 250 mm, and in some examples 150 mm
L2=0 mm to 100 mm, and in some examples 40 mm L3=75 mm to 300 mm, and in some examples 200 mm The wider forefoot and/or instep section 522 (e.g., having width W1) of strap portions 520A and/or 520B (as compared to the midfoot and/or heel/ankle section 526) may provide a wider area over which force is applied to a wearer's foot when the strap portion(s) 520A, 520B are tightened, thereby improving the comfort of the strap portion 520A/520B on the wearer's foot and directly engaging a larger portion of the wearer's foot. The narrower midfoot and/or heel/ankle section 526 can reduce the size of the lock 330 and the hardware associated with it, thereby reducing its weight and/or bulkiness and making the strap portions 520A/520B easier to handle. The strap portions 520A and 520B may have the same or different L1, L2, L3, W1, and/or W2 dimensional characteristics in a single footwear 500 structure.

Alternatively, either or both of strap sections 520A and/or 520B may have a constant width over their entire longitudinal lengths; either or both of strap sections 520A and/or 520B may have a continuously tapering width over their entire longitudinal lengths; and/or either or both of strap sections 520A and/or 520B may have one or more stepped width changes or otherwise varied width changes over their longitudinal lengths.

III. CONCLUSION

The present invention is disclosed above and in the accompanying drawings with reference to a variety of embodiments and/or features. The purpose served by the disclosure, however, is to provide examples of various features and concepts related to the invention, not to limit the scope of the invention. One skilled in the relevant art will recognize that numerous variations and modifications may be made to the features of the invention described above without departing from the scope of the present invention, as defined by the appended claims.

What is claimed is:

1. An article of footwear having a first side and a second side, the article of footwear comprising:

a sole structure;

an upper engaged with the sole structure and formed from one or more upper parts, wherein the upper includes: (a) an ankle-containing portion having a first side located on the first side of the article of footwear and a second side located on the second side of the article of footwear, (b) a heel-containing portion having a first side located on the first side of the article of footwear and a second side located on the second side of the article of footwear, (c) an instep-containing portion, and (d) a rear heel area having one or more openings defined therein, the rear heel area comprising a heel support having a lock;

a closure system engaged with the upper, wherein the closure system includes:

(a) a track that extends from a first end located at the first side of the ankle-containing portion to a second end located at the instep-containing portion, wherein the track extends around a rear ankle area of the ankle-containing portion, along the second side of the ankle-containing portion, and to the instep-containing portion of the upper, and (b) a slider engaged with the track, wherein the slider is movable along the track to change the closure system between an open condition and a closed condition;

wherein the first end of the track is distant from a top of a foot insertion opening of the upper;

an ankle strap engaged with the slider and extending from the first side of the ankle-containing portion to the second side of the ankle-containing portion when the closure system is in the closed condition; and a fastener releasably securing the ankle strap with the upper at the second side of the ankle-containing portion when the closure system is in the closed condition;

a first strap section extending between overlapping layers of the upper over at least a portion of a length of the first strap section, wherein the first strap section includes a first end permanently engaged with at least one of the upper and the sole structure at a forefoot area or a midfoot area of the article of footwear on the first side of the article of footwear, and wherein the first strap section extends along the second side of the heel-containing portion of the upper to the rear heel area of the upper;

a second strap section extending between overlapping layers of the upper over at least a portion of a length of the second strap section, wherein the second strap section includes a second end permanently engaged with at least one of the upper and the sole structure at the forefoot area or the midfoot area of the article of footwear on the second side of the article of footwear, wherein the second strap section extends along the first side of the heel-containing portion of the upper to the rear heel area of the upper, and wherein the first strap section crosses the second strap section at an instep area of the article of footwear; and a securing system engaged with the first strap section and the second strap section and releasably holding the first strap section and the second strap section in a tightened condition, wherein the securing system includes the lock having: (a) a base engaged with the upper at the rear heel area of the upper and (b) one or more openings defined through the base positioned in line with the one or more openings defined in the upper, wherein the first strap section: (a) exits the upper through one of the one or more openings defined in the rear heel area of the upper and (b) extends through the base through one of the one or more openings defined through the base, and wherein the second strap section: (a) exits the upper through one of the one or more openings defined in the rear heel area of the upper and (b) extends through the base through one of the one or more openings defined through the base.

2. The article of footwear according to claim 1, wherein the second end of the track is located at a first side of the instep-containing portion of the upper and the track extends across a central longitudinal axis of the upper at a forefoot portion of the upper.

3. The article of footwear according to claim 1, wherein the overlapping layers of the upper include an exterior component and an interior component, wherein the closure system is engaged with the exterior component, and wherein the interior component includes a foot-receiving bootie.

4. The article of footwear according to claim 1, wherein the second end of the track is located at the second side of the article of footwear at the instep-containing portion of the upper and the track terminates at a forefoot portion of the upper at or before reaching a central longitudinal axis of the upper at the forefoot portion of the upper.

5. An article of footwear having a first side and a second side, the article of footwear comprising:

an upper including: (a) a first upper component including an ankle-containing portion, the ankle-containing portion having a first side located on the first side of the article of footwear and a second side located on the second side of the article of footwear, wherein the first upper component includes one or more openings defined therein at a rear heel area of the upper, and (b) a second upper component including a heel-containing portion, the heel-containing portion having a first side located on the first side of the article of footwear and a second side located on the second side of the article of footwear;

a sole structure engaged with at least one of the first upper component or the second upper component;

a foot-insertion opening at least in part defined by the first upper component, wherein the foot-insertion opening extends: (a) from the first side of the ankle-containing portion of the first upper component, (b) around a rear ankle area of the first upper component, (c) along the second side of the ankle-containing portion of the first upper component, and (d) to an instep-containing portion of the first upper component;

a first strap section extending between the first upper component and the second upper component and across the instep-containing portion of the first upper component, wherein the first strap section includes a first end permanently engaged with at least one of the upper or the sole structure at a forefoot area or a midfoot area of the article of footwear on the first side of the article of footwear, and wherein the first strap section extends along the second side of the heel-containing portion of the second upper component to the rear heel area of the upper;

a second strap section extending between the first upper component and the second upper component and across the instep-containing portion of the first upper component, wherein the second strap section includes a second end permanently engaged with at least one of the upper or the sole structure at the forefoot area or the midfoot area of the article of footwear on the second side of the article of footwear, wherein the second strap section extends along the first side of the heel-containing portion of the second upper component to the rear heel area of the upper, and wherein the first strap section crosses the second strap section at an instep area of the upper;

a track engaged with the first upper component and a slider engaged with the track, wherein movement of the slider along the track changes the foot-insertion opening between an open condition and a closed condition, wherein the first end of the track is distant from a top of a foot insertion opening of the upper;

an ankle strap engaged with the slider or at least one of the first upper component or the second upper component; and a fastener releasably securing the ankle strap with at least one of the first upper component or the second upper component when the foot-insertion opening is in the closed condition; and a lock releasably holding at least one of the first strap section or the second strap section in a tightened condition, and wherein the lock includes: (a) a base engaged with the first upper component at the rear heel area of the upper and (b) one or more openings defined through the base positioned in line with the one or more openings defined in the first upper component, wherein the first strap section: (a) exits the upper through one of the one or more openings defined in the first upper component and (b) extends through the base through one of the one or more openings defined through the base, and wherein the second strap section: (a) exits the upper through one of the one or more openings defined in the first upper component and (b) extends through the base through one of the one or more openings defined through the base.

6. The article of footwear according to claim 5 wherein the ankle strap is engaged with the slider.

7. The article of footwear according to claim 5, wherein the ankle strap is engaged with at least one of the first upper component or the second upper component.

8. The article of footwear according to claim 5, wherein the first upper component includes an exterior upper component, wherein the second upper component is at least partially received in the exterior upper component, and wherein the second upper component includes a foot-receiving bootie.

9. The article of footwear according to claim 5, wherein the first upper component includes an exterior upper component, and wherein the second upper component is at least partially received in the exterior upper component.

10. The article of footwear according to claim 5, wherein the lock includes a spring loaded lock component biased to hold the first strap section in a locked configuration.

11. The article of footwear according to claim 5, wherein the one or more openings defined in the first upper component at the rear heel area of the upper includes a first opening through which the first strap section extends, wherein the one or more openings defined in the first upper component at the rear heel area of the upper includes a second opening through which the second strap section extends, and wherein the lock further includes a spring loaded lock component biased to hold the first strap section and the second strap section in a locked configuration.

12. The article of footwear according to claim 1, wherein the lock includes a spring loaded lock component biased to hold the first strap section in a locked configuration.

13. The article of footwear according to claim 1, wherein the one or more openings defined in the rear heel area of the upper includes a first opening through which the first strap section extends, wherein the one or more openings defined in the rear heel area of the upper includes a second opening through which the second strap section extends, and wherein the lock further includes a spring loaded lock component biased to hold the first strap section and the second strap section in a locked configuration.

14. The article of footwear according to claim 1, wherein the one or more openings defined in the rear heel area of the upper includes a first opening through which the first strap section extends, and wherein the one or more openings defined in the rear heel area of the upper includes a second opening through which the second strap section extends.

15. The article of footwear according to claim 14, wherein the one or more openings defined through the base includes a third opening through which the first strap section extends and a fourth opening through which the second strap section extends.

16. The article of footwear according to claim 5, wherein the one or more openings defined in the first upper component at the rear heel area of the upper includes a first opening through which the first strap section extends, and wherein the one or more openings defined in the first upper component at the rear heel area of the upper includes a second opening through which the second strap section extends.

17. The article of footwear according to claim 16, wherein the one or more openings defined through the base includes a third opening through which the first strap section extends and a fourth opening through which the second strap section extends.

* * * * *